US007320385B2

(12) United States Patent
Katae et al.

(10) Patent No.: US 7,320,385 B2
(45) Date of Patent: Jan. 22, 2008

(54) CAMERA LIFTING APPARATUS AND CARGO HANDLING OPERATION AIDING APPARATUS IN INDUSTRIAL VEHICLE AND INDUSTRIAL VEHICLE

(75) Inventors: Kenichi Katae, Kariya (JP); Hisashi Ichijo, Kariya (JP); Torahiko Yamanouchi, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 388 days.

(21) Appl. No.: 10/470,394

(22) PCT Filed: Feb. 18, 2002

(86) PCT No.: PCT/JP02/01351

§ 371 (c)(1),
(2), (4) Date: Jul. 25, 2003

(87) PCT Pub. No.: WO02/064490

PCT Pub. Date: Aug. 22, 2002

(65) Prior Publication Data

US 2004/0098146 A1 May 20, 2004

(30) Foreign Application Priority Data

Feb. 16, 2001 (JP) ..... 2001-040111
Oct. 24, 2001 (JP) ..... 2001-326656

(51) Int. Cl.
*B66F 9/06* (2006.01)

(52) U.S. Cl. ..... 187/227; 187/222; 187/224; 212/350

(58) Field of Classification Search ..... 187/227, 187/222, 224; 212/350; 384/126, 127
See application file for complete search history.

(56) References Cited

U.S. PATENT DOCUMENTS

| | | | | |
|---|---|---|---|---|
| 3,319,816 | A * | 5/1967 | Christenson | 414/636 |
| 4,234,057 | A * | 11/1980 | Nakane et al. | 187/238 |
| 4,279,328 | A * | 7/1981 | Ahlbom | 187/224 |
| 4,957,408 | A * | 9/1990 | Ohkura | 414/635 |
| 5,011,358 | A * | 4/1991 | Andersen et al. | 414/273 |
| 5,586,620 | A * | 12/1996 | Dammeyer et al. | 187/227 |
| 5,738,187 | A * | 4/1998 | Dammeyer et al. | 187/222 |
| RE37,215 | E * | 6/2001 | Dammeyer et al. | 187/222 |
| 6,611,746 | B1 * | 8/2003 | Nagai | 701/50 |
| 2004/0098146 | A1 * | 5/2004 | Katae et al. | 700/50 |

FOREIGN PATENT DOCUMENTS

| | | |
|---|---|---|
| JP | 54-144658 | 11/1979 |
| JP | 06-135698 | 5/1994 |
| JP | 06-239410 | 8/1994 |
| JP | 11-278799 | 10/1999 |
| JP | 2001-002395 | 1/2001 |

* cited by examiner

*Primary Examiner*—Patrick Mackey
*Assistant Examiner*—Terrell Matthews
(74) *Attorney, Agent, or Firm*—Morgan & Finnegan, LLP

(57) ABSTRACT

A camera lifting apparatus is used in an industrial vehicle equipped with a cargo handling apparatus for lifting a cargo carrying carriage up and down along a mast provided on a vehicle body. The carriage has a cargo carrying apparatus. The camera lifting apparatus comprises a camera unit attached to the cargo carrying apparatus. The camera unit has a camera for picking up an image of a work area of the cargo carrying apparatus. A moving mechanism moves the camera unit relatively to the cargo carrying apparatus. An actuator drives the moving mechanism.

16 Claims, 19 Drawing Sheets

Fig.13
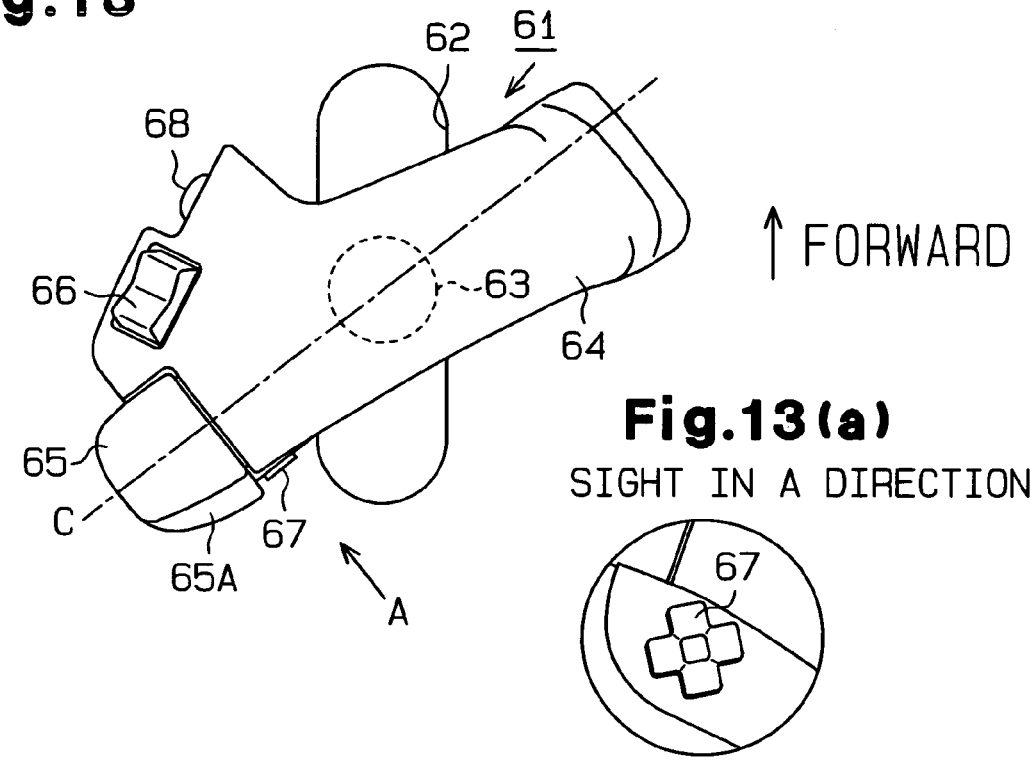
Fig.13(a)
SIGHT IN A DIRECTION
Fig.14
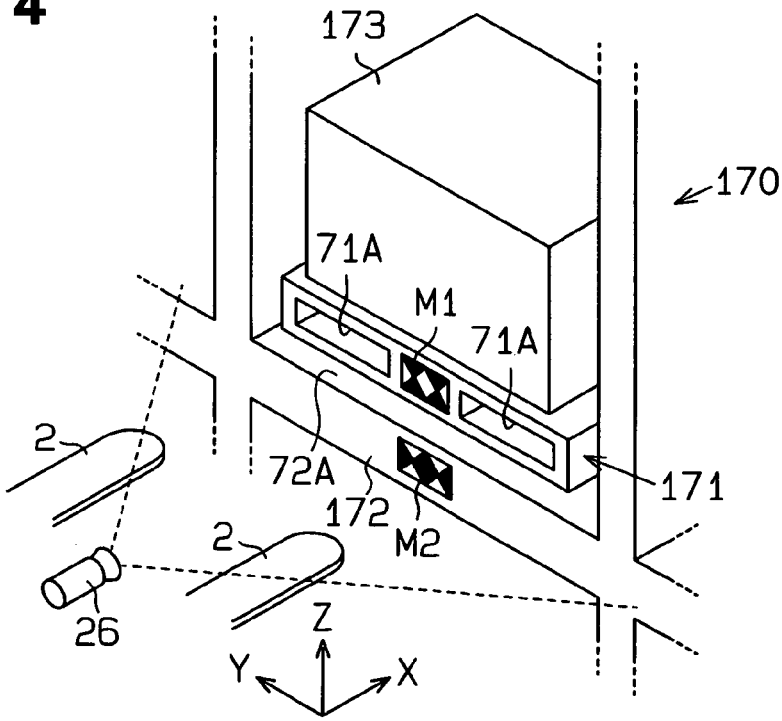

CAMERA LIFTING APPARATUS AND CARGO HANDLING OPERATION AIDING APPARATUS IN INDUSTRIAL VEHICLE AND INDUSTRIAL VEHICLE

BACKGROUND OF THE INVENTION

The present invention relates to a camera lifting apparatus equipped with a camera unit for picking up the image of a work area of a cargo carrying apparatus, such as forks, at the time of doing a cargo carrying work in a high position and a cargo handling operation aiding apparatus in an industrial vehicle equipped with a carriage which is lifted up and down along a mast, such as, for example, a forklift.

For example, the vehicle body of a forklift which is an industrial vehicle is equipped with a multi-level mast that lifts a carriage having an attachment, such as forks, up and down. At the time of performing load pickup or load deposition at a high place in a rack, a driver operates a lift lever to protract or retract the multi-level mast by hydraulic driving. Further, the driver moves the forks upward along the mast to position the forks to a predetermined position with respect to a shelf surface or a pallet on a rack (cargo handling lever operation).

At the time of the positioning work, the driver must manipulate the lift lever while checking with the eyes if the forks are positioned to holes in the pallet or slightly above the shelf surface by looking up at a high place (e.g., 3 to 6 meters). It is however extremely difficult to determine if the forks and a pallet or the like are horizontally positioned with the eyes by looking up at a high place from below, and even a skilled person needs time for this positioning. In case of moving the forks gradually closer to a load or a rack by manipulating the lift lever, for example, the work should be carried out carefully, thus lowering the working efficiency.

There is an apparatus known that has, for example, a camera attached to the carriage and allows the driver to see a picked up image of a rack or a pallet which is seen in front of the forks via the screen of a display device at the driver's seat in order to solve the above problem. This apparatus aids the positioning work of the forks at a high place.

In the conventional apparatus, the camera is fixed to the distal end portion or the side portion of the forks or a predetermined position of the mast. The place where the image of the work area can be picked up approximately from the front is desirable as the place for securing the camera. In case where the camera is fixed in the vicinity of the proximal end portion of the forks, while the image of the work area can be picked up widely at the time of load pickup, a load on the forks interferes at the time of load deposition, thus allowing image pickup of only a narrow work area around the shelf surface where the load is to be deposited. Therefore, the camera attaching position was limited to a place, such as the distal end portion of the forks or the side surface of the forks, where miniaturization of the camera would be required. The restriction of the camera attaching position might result in a case where the optimal aiding would be difficult.

To solve the above problem, U.S. Pat. No. 5,586,620, for example, discloses an apparatus which has a camera attached to the carriage of a forklift to allow a picked-up image of the state of a rack, a pallet or the like seen in front of the forks to be seen on the screen of a display device at the driver's seat, thereby supporting the work of positioning the forks at a high place. The camera can be lifted up and down with respect to the carriage via a lifting mechanism. Further, the camera is attached to the carriage in such a way as to be urged downward by a spring. When the carriage moves down near to a lowest lift-down position, the camera abuts on a plate provided on the mast so that the camera moves upward against the urging force of the spring and is stored in a protection position. When the forks moved upward by a predetermined distance from the lowest lift-down position, the camera moves down from the carriage to be able to pick up an image in front of the forks. When the forks are moved down, the camera moves upward before the forks reach the lowest lift-down position and is stored in the protection position. Therefore, the collision of the camera against the floor is avoided.

In the case of the apparatus described above, the camera was always projecting downward from the carriage at a height equal to or higher than a position where the camera would move downward from the protection position (a height above the lowest lift-down position of the forks by a predetermined distance). That is, the image pickup position of the camera was fixed to a position below the forks by a predetermined distance in a load pickup work as well as a load deposition work. The arrangement of the camera below the forks by a predetermined distance is for picking up an image near the front of the forks without being interfered with a load on the forks at the time of load deposition.

From the viewpoint of aiding the positioning of the forks, it is desirable to provide an image picked up from the same height as the insertion sections of the forks. At the time of load deposition with no load that blocks the image pickup of the camera lies on the forks, particularly, it is desirable to arrange the camera at the same height as the insertion sections of the forks.

In the above apparatus, when the forks are located at a high place, the camera is projecting downward. Therefore, the camera might interfere with objects around at the time of a cargo carrying work.

The greater the amount of projection and the frequency of projection (or the projecting time) of the camera from the carriage, the greater the frequency of occurrence of the interference of the camera with surrounding objects. According to the conventional apparatus, the camera is likely to be interfered with surrounding objects and image pickup should be carried out from a low angle below the forks in load pickup mode.

There may be case where the positions of the forks with respect to a target are recognized using an image recognition technique based on an image picked up by the camera and a voice announce or the like is made to position the forks to the target or the like. In this case, it is preferable that the image of a target, such as a pallet or a rack, should be picked up from the front. That is, it is desirable that a pallet be a target in load pickup mode and a rack be a target in load deposition mode. Because the camera in the apparatus described in the aforementioned publication was secured relatively to the forks, however, it was not possible to change the position of the camera in accordance with a target that would differ in the contents of work.

The publication described above also discloses the structure that moves a single camera to a plurality of positions and a technique that can switch a plurality of image pickup positions using two cameras.

However, the image pickup positions could not be switched by changing the positions of the cameras at arbitrary heights. In case where plural cameras are arranged, extra cameras are needed and control of display on the screen of the display device becomes complicated.

BRIEF SUMMARY OF THE INVENTION

It is a first object of the present invention to provide a camera lifting apparatus in an industrial vehicle, which can move a camera unit at an arbitrary height regardless of the heights of forks and can provide an adequate picked-up image of a cargo carrying work which is carried out at a high place.

It is a second object of the present invention to provide a camera lifting apparatus in an industrial vehicle, which can suppress the transmission of shocks of a camera unit hitting against a floor to an actuator.

It is a third object of the present invention to provide a cargo handling operation aiding apparatus in an industrial vehicle and an industrial vehicle, which can provide an adequate picked-up image according to a cargo carrying work by moving a camera to an image pickup position according to the cargo carrying work and can effectively support the cargo carrying work through the provided picked-up image.

It is a fourth object of the present invention to avoid the interference of a camera with surrounding objects at the time of a cargo carrying work.

To overcome the above-described problems, the present invention provides the following camera lifting apparatus. The camera lifting apparatus is used in an industrial vehicle equipped with a cargo handling apparatus for lifting a cargo carrying carriage up and down along a mast provided on a vehicle body. The carriage has a cargo carrying apparatus. The camera lifting apparatus comprises a camera unit, a moving mechanism, and an actuator. The camera unit is attached to the cargo carrying apparatus. The camera unit has a camera for picking up an image of a work area of the cargo carrying apparatus. The moving mechanism moves the camera unit relatively to the cargo carrying apparatus. The actuator drives the moving mechanism.

The present invention further provides the following cargo handling operation aiding apparatus. The cargo handling operation aiding apparatus in which a cargo carrying apparatus is provided movable with respect to a vehicle body is used in an industrial vehicle that performs plural cargo carrying works including transportation. The cargo handling operation aiding apparatus has a camera for picking up images of image pickup areas suitable for the cargo carrying works. A moving mechanism moves the camera to an image pickup position according to a cargo carrying work. An actuator drives the moving mechanism. State detecting means detects a working state of the vehicle to discriminate the cargo carrying work. A controller controls the actuator in such a way that the camera is placed in an image pickup position according to that cargo carrying work which is discriminated from a result of detection by the state detecting means.

The present invention provides another cargo handling operation aiding apparatus. The cargo handling operation aiding apparatus is used in an industrial vehicle equipped with a cargo carrying apparatus provided movable with respect to a vehicle body for doing cargo carrying work. The cargo handling operation aiding apparatus has a camera for picking up an image of a work area of the cargo carrying apparatus. A moving mechanism supports the camera in such a manner as to be movable with respect to the vehicle. An actuator drives the moving mechanism. State detecting means detects a working state of the vehicle to discriminate the cargo carrying work. A controller controls the actuator in such a way that the camera is placed in an image pickup position according to that cargo carrying work which is discriminated based on a result of detection by the state detecting means.

The present invention provides another cargo handling operation aiding apparatus. The cargo handling operation aiding apparatus is used in an industrial vehicle in which a carriage having a cargo carrying apparatus is so provided as to be liftable up and down along a mast. The cargo handling operation aiding apparatus has a camera for picking up an image of a work area of the cargo carrying apparatus. A moving mechanism supports the camera in such a manner as to be movable with respect to the carriage. An actuator drives the moving mechanism. State detecting means detects a working state of the vehicle to discriminate whether the cargo carrying work is a load pickup work or a load deposition work. A controller controls the actuator in such a way as to place the camera in a storage position where the camera does not project from the carriage when determining based on a result of detection by the state detecting means that the cargo carrying work is the load pickup work, and to place the camera in a position where the camera projects from the carriage to secure an image pickup area without blocking the image pickup area with a load on the cargo carrying apparatus when determining that the cargo carrying work is the load deposition work.

The present invention provides another cargo handling operation aiding apparatus. The cargo handling operation aiding apparatus is used in an industrial vehicle in which a carriage having a cargo carrying apparatus is so provided as to be liftable up and down along a mast. The cargo handling operation aiding apparatus has a camera for picking up an image of a work area of the cargo carrying apparatus. A lifting mechanism supports the camera in such a manner as to be able to lift the camera up and down with respect to the carriage between a storage position where the camera does not project downward from the carriage and a lift-down position where the camera projects downward from the carriage. An actuator drives the lifting mechanism. State detecting means detects a working state of the vehicle to discriminate whether the cargo carrying work is a load pickup work or a load deposition work. Height detecting means detects a height of the cargo carrying apparatus. A controller controls the actuator in such a way as to place the camera in the storage position when determining, based on a result of detection by the height detecting means, that the height of the cargo carrying apparatus is less than a threshold value, to place the camera in the storage position when the height of the cargo carrying apparatus is equal to or greater than the threshold value and it is determined based on a result of detection by the state detecting means that the cargo carrying work is the load pickup work, and to place the camera in the lift-down position when determining, based on the result of detection by the height detecting means, that the cargo carrying work is the load deposition work.

The present invention further provides another cargo handling operation aiding apparatus. The cargo handling operation aiding apparatus is used in an industrial vehicle in which a carriage having a cargo carrying apparatus is so provided as to be liftable up and down along a mast. The cargo handling operation aiding apparatus has a camera for picking up an image of a work area of the cargo carrying apparatus. A moving mechanism supports the camera in such a manner as to be movable with respect to the carriage between a storage position, where the camera does not project from the carriage, and a projection position where the camera projects from the carriage. An actuator drives the moving mechanism. State detecting means detects a working state of the vehicle to discriminate whether the cargo carrying work is a load pickup work or a load deposition work. Approaching detecting means detects that the camera has approached a cargo handling target. A controller controls the actuator in such a way as to place the camera in the storage position when the controller determines, based on a result of detection by the state detecting means, that the cargo carrying work is the load pickup work, to place the camera in the projection position when determining that the cargo carrying work is the load deposition work, and to place the camera in the storage position when determining, based on a result of detection by the approaching detecting means, that the camera has approached the cargo handling target within a predetermined distance.

BRIEF DESCRIPTION OF DRAWINGS

FIG. 9(*b*) is a cross-sectional view showing a state in which the two holders abut on each other.

FIG. 13 is a plan view of an operation lever according to a fourth embodiment of the present invention.

FIG. 13(*a*) is a plan view of a cross switch as seen from an A direction in FIG. 13.

FIG. 14 is a perspective view showing a state of a cargo carrying work with respect to a rack.

FIG. 16(*b*) is a diagram showing a template for the mark M1.

FIG. 16(*c*) is a diagram showing a mark M2.

FIG. 16(*d*) is a diagram showing a template for the mark M2.

FIG. 17(*b*) is a diagram showing a state in which the mark M1 is matched at two locations.

FIG. 20(*b*) is a diagram showing a state in which forks are arranged at a load deposition position.

FIG. 20(*c*) is a diagram showing a state in which a mast is reached for a load deposition work.

FIG. 20(*d*) is a diagram showing a state in which the forks carrying a load are moved down.

DETAILED DESCRIPTION OF THE PREFERRED EMBODIMENTS

A first embodiment of the present invention as embodied into a reach type forklift 1 as an industrial vehicle will be described below with reference to FIGS. 1 to 10.

Figure 1:
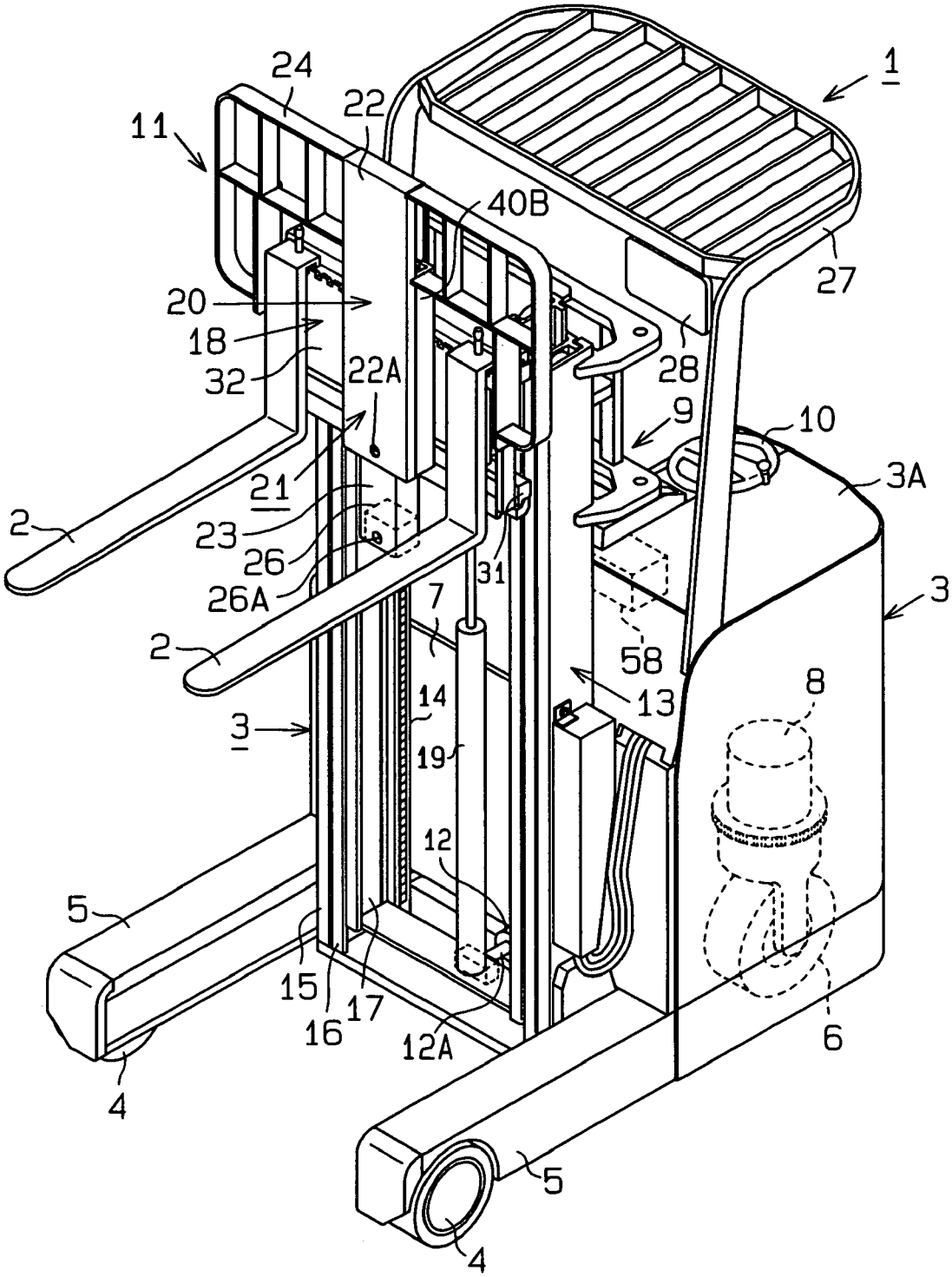
FIG. 1 is a perspective view of a forklift according to a first embodiment in which the present invention is embodied.

As shown in FIG. 1, the forklift 1 is used to do a cargo carrying work in, for example, a factory. As a cargo carrying work, forks 2 as a cargo carrying apparatus are lifted up and down with respect to a rack provided upright in, for example, a factory to do load pickup and load deposition works. In a load pickup work, the forks 2 are inserted into a pallet 171 (see FIG. 14) stored, while carrying a load, in a rack. In this work, the forks 2 need to be positioned to the insertion holes of the pallet. In a load deposition work, a load (pallet) carried on the forks 2 are placed on a shelf surface 72A. In this work, the forks 2 should be positioned at a predetermined height above the shelf surface 72A (e.g., 10 to 20 cm above the shelf surface).

The forklift 1 is a three-wheel type with two front wheels and one rear wheel. The right and left front wheels (driven wheels) 4 are attached to the distal end portions of a pair of right and left reach legs 5 extending frontward from the front portion of a vehicle body 3. The single rear wheel is a drive wheel 6 which serves as a steered tire wheel. The drive wheel 6 is driven by power of a drive motor 8 which is driven with a battery 7, as a power source, installed in the vehicle body 3. Casters (not shown) which support the drive wheel 6 as rear wheels are also provided.

A stand-up type driver's seat 9 is provided on the right-hand side of the rear portion of the vehicle body 3. A handle (steering wheel) 10 is provided on the top surface of a retainer box 3A provided upright on the left-hand side of the driver's seat 9. The drive wheel 6 is steered according to the manipulation of the steering wheel 10.

A mast assembly 11 as a cargo handling apparatus is equipped on the front portion of the vehicle body 3 between the pair of reach legs 5 in such a way as to be movable forward and backward. A piston rod 12*a* of a reach cylinder (hydraulic cylinder) 12 provided on the bottom portion of the vehicle body 3 is coupled to the mast assembly 11. The driving of the reach cylinder 12 causes the mast assembly 11 to move forward and backward (reach operation). The vehicle disclosed in U.S. Pat. No. 5,586,620 discussed in the Prior Art is of a pantograph reach type, whereas the vehicle in the present embodiment employs a mast reach type.

The mast assembly 11 has a multi-level (three-level in the present embodiment) mast 13 and lift cylinders 14 (only one shown). The mast assembly 11 is a telescopic type (full free type) whose drive sources are a center lift cylinder 19 and a pair of lift cylinders 14 provided on the mast 13. The mast 13 is a three-level mast comprising an outer mast 15, a middle mast 16, and an inner mast 17 and is engaged in a slidable manner. Each mast 15, 16, 17 is comprised of a pair of mast members and a beam member, which couples both mast members.

The mast 13 is equipped with a cargo carrying carriage (fork unit) 18 in a liftable manner. The carriage 18 is guided to the inner mast 17 and is suspended from the inner mast 17 via a chain mechanism (not shown). As the center lift cylinder 19 is driven, the carriage 18 alone is lifted up and the carriage 18 reaches the topmost position of the inner mast 17. As the lift cylinders 14 are driven thereafter, the mast 13 is protracted or retracted, causing the carriage 18 to be lifted in the up and down directions along the mast 13. After the carriage 18 is lifted up to the mast upper end position from the lowest lift-down position, the protracting operation of the multi-level mast 13 is started. The forks 2 move up to a maximum height of about 6 meters.

The forklift 1 is provided with a cargo handling operation aiding apparatus 20 which supports an operation of positioning the forks 2 at a high place. The aiding apparatus 20 has a camera lifting apparatus 21 installed at the front center portion of the carriage 18. The camera lifting apparatus 21 has a lift type camera unit 23 movable downward from the lower end of a housing 22. The housing 22 is attached to the widthwise center portion of the carriage 18 in a state extending in the up and down directions. The front side of the housing 22 is approximately in level with the front side of a back rest 24. The camera unit 23 incorporates a camera (CCD camera) 26 at the lower end portion of a case 25 and has an image pickup section (lens section) 26A at the front lower end portion of the case 25.

The camera unit 23 is lifted up and down between two positions, a storage position (see FIG. 2) where it is stored in the housing 22 and a lift-down position (see FIG. 3) shown in FIG. 1. An image pickup window 22A is formed in the front lower portion of the housing 22 in such a way as to correspond to the image pickup section 26A of the camera unit 23 placed in the storage position. In the storage position, the camera 26 can pick up an image of the front side of the forks 2 via the image pickup window 22A. That is, the camera lifting apparatus 21 can pick up the images of the front side of the forks 2 at the two positions, the storage position and the lift-down position, by the camera 26.

A display device (liquid crystal display device (LCD)) 28 is attached to a roof 27 in such a way that a driver standing on the driver's seat 9 sees it well. The image of a rack or a pallet in front of the forks 2, picked up by the camera 26 at the time of a cargo carrying work, is shown on the screen of the display device 28.

The structures of the carriage 18 and the camera lifting apparatus 21 will be described below based on FIGS. 2 to 8.

Figure 4:
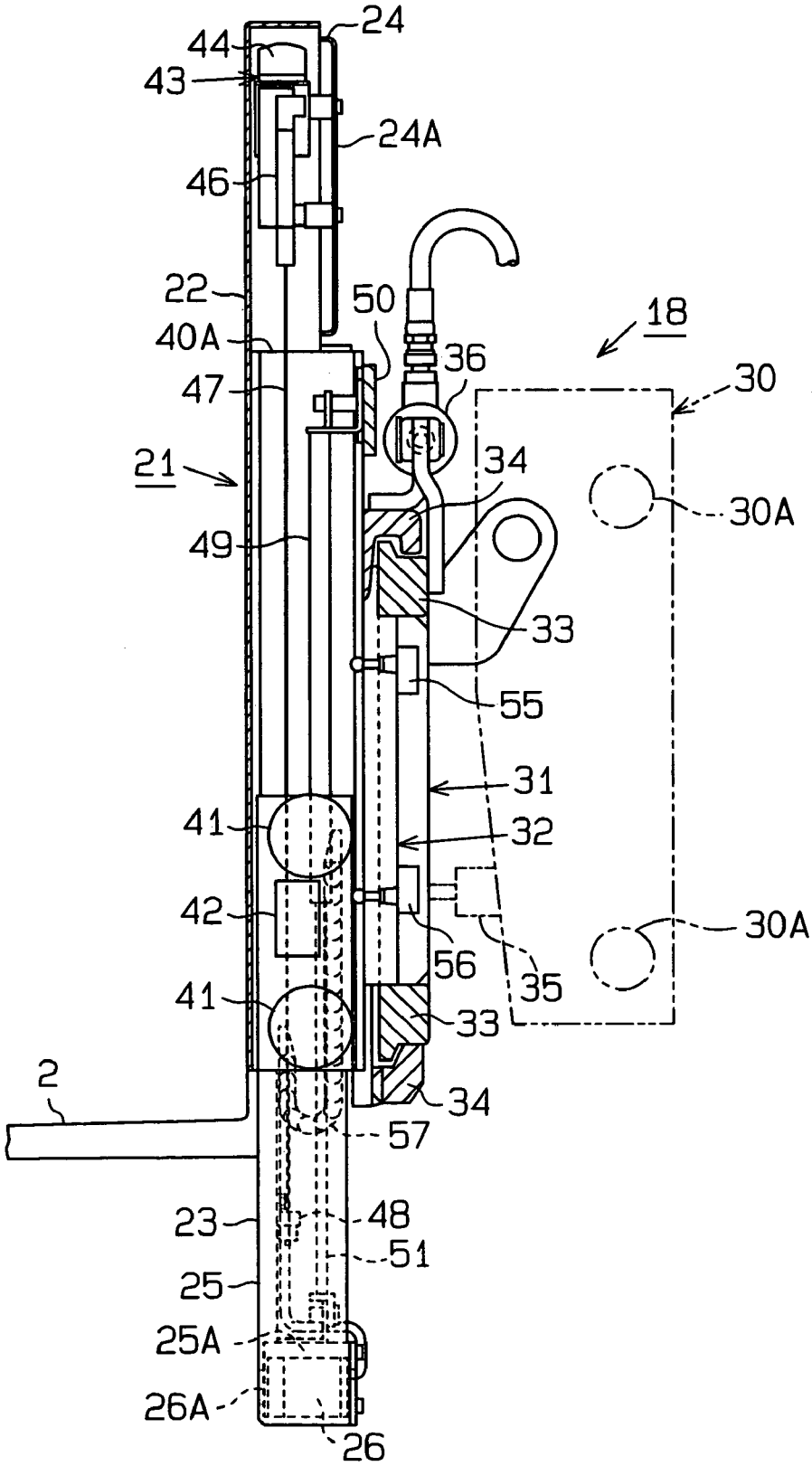
FIG. 4 is a cross-sectional view of the carriage.

As shown in FIG. 4, the carriage 18 includes a lift bracket 30, a finger bar 31, a side shifter 32, the back rest 24, and the forks 2. As the forks 2 are an attachment, they can be replaced with another attachment in accordance with the purpose of a cargo carrying work.

The lift bracket 30 is arranged over the mast 13 in a liftable manner. That is, the lift bracket 30 has plural (two) rollers 30A (shown in FIG. 4) on its either side, which roll on guide surfaces (inner surfaces) of the inner mast 17 and which are suspended in a liftable manner by a chain (not shown). The finger bar 31 as a tilt support member is supported in a state tiltable forward and backward with respect to the lift bracket 30.

A pair of support rails 33 is fixed to both upper and lower ends of the finger bar 31 and extend along the vehicle's widthwise direction. Two guide rails 34 of the side shifter 32 are respectively engaged with the corresponding support rails 33. Therefore, the side shifter 32 is slidable in the vehicle's widthwise direction (the right and left directions) along the rails 33. The back rest 24 is secured to the upper portion of the side shifter 32. The forks 2 are attached to the side shifter 32 in a detachable manner.

A tilt cylinder 35, which tilts the finger cover 31 is provided in the lift bracket 30. As the tilt cylinder 35 is driven, the finger bar 31 is tilted. The tilting of the finger bar 31 causes the forks 2 to perform a tilt operation. A side shift cylinder 36 is provided on the upper portion of the finger bar 31 and its piston rod 36A is coupled to the side shifter 32. As the side shift cylinder 36 is driven, the side shifter 32 is relatively movable by a predetermined distance (e.g., 50 to 100 mm) rightward and leftward with respect to the finger bar 31 from the widthwise center thereof (mark ▼ in FIG. 3).

The structure of the camera lifting apparatus 21 will now be described in detail based on FIGS. 2 to 9.

Figure 5:
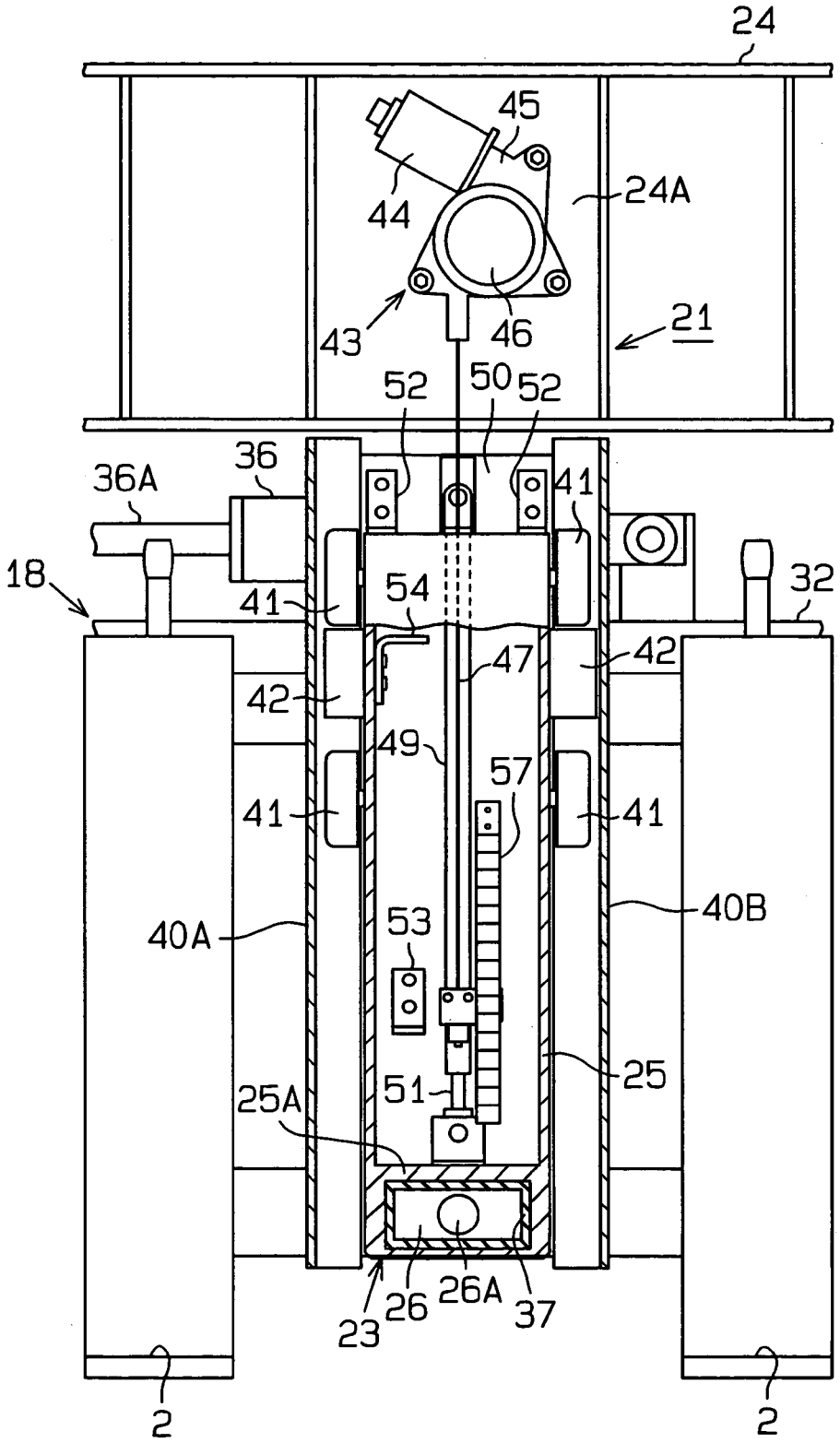
FIG. 5 is a cross-sectional view of the camera lifting apparatus.
Figure 6:
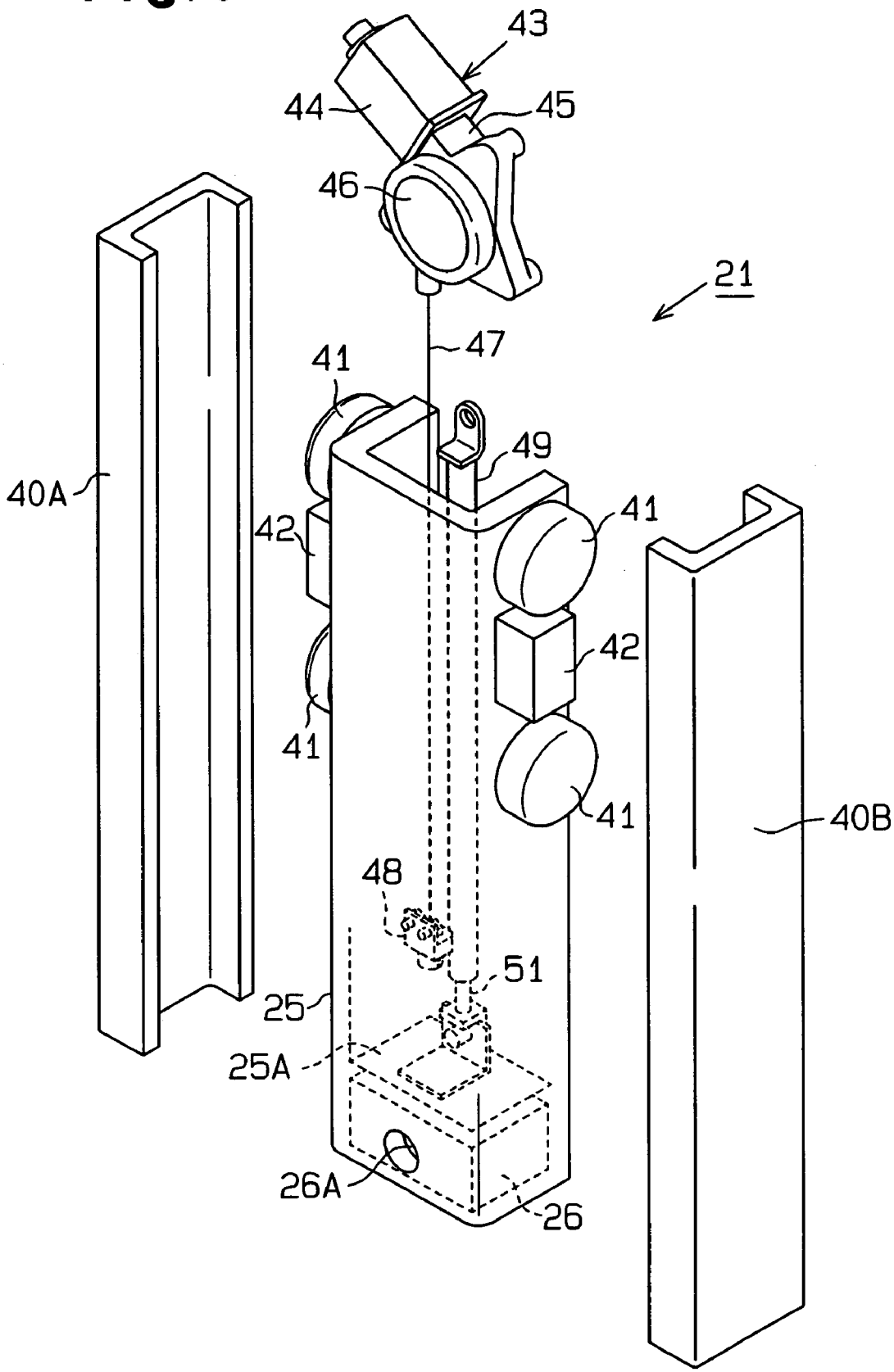
FIG. 6 is a partly exploded perspective view of the camera lifting apparatus.

The camera lifting apparatus 21 has a pair of guide rails 40A and 40B attached to the widthwise center portion of the side shifter 32. The camera unit 23 is guided to both guide rails 40A and 40B and is supported in a liftable manner. As shown in FIG. 6, the case 25 of the camera unit 23 has a columnar shape with a U-shaped cross section. A partition 25A for defining space for retaining the camera 26 is formed on the bottom portion of the case 25. As shown in FIG. 5, the camera 26 is covered around with a cushioning material (rubber cushion) 37 excluding the lens section 26A. If the camera unit 23 collides with a surrounding obstacle due to an erroneous operation by the driver, the cushioning material 37 absorbs the impact so that the camera 26 is protected against the impact. Mast rail members having a rigidity are used for both guide rails 40A and 40B. Both guide rails 40A and 40B are covered with a rigid material so that they are not easily broken even if the driver hits the case 25 against the rack or the like through an erroneous operation and a slight impact is applied.

Two rollers (roller bearings) 41 are rotatably provided on each side wall of the case 25. The individual rollers 41 roll on the guide rails 40A and 40B. A resin block 42 as a pressure receiving member which serves as a bearing when the thrust load is received is secured between both rollers 41 on each side wall of the case 25. The resin block 42 slides on the inner surfaces of the guide rails 40A and 40B in such a way that the thrust load is not applied to the rollers 41.

As shown in FIG. 5, a support plate 24A nearly equivalent to the distance between both guide rails 40A and 40B is secured to the back rest 24. An electric motor unit 43 as an actuator is provided on the support plate 24A. The electric motor unit 43 has an electric motor 44, a gear box 45, and a drum 46 as a rotary body. As shown in FIGS. 4 and 6, a wire 47 as a flexible power transmitting member is wound around in the drum 46. The wire 47 extending downward from the drum 46 is positioned on the widthwise center line of the case 25. The lower end of the wire 47 is coupled to the inner surface of the case 25 via a tensioner 48. As the electric motor 44 is driven, the drum 46 is rotated forward or reverse via the gear box 45. In accordance with the forward or reverse rotation of the drum, the wire 47 wound around the drum 46 is selectively wound up or fed out. The case 25 is lifted up and down in accordance with the winding-up and feeding-out of the wire 47 by the electric motor 44.

A gas damper 49 as urging means is provided in the case 25. As shown in FIG. 5, the upper end portions of both guide rails 40A and 40B are coupled by a beam (plate member) 50.

The proximal end portion of the gas damper 49 is fixed to the beam 50. The gas damper 49 is so arranged as to extend along the up and down directions at the widthwise center position of the case 25. A piston rod 51 is arranged at the distal end portion of the gas damper 49. The proximal end portion of the piston rod 51 is secured to the partition 25A of the case 25. The gas damper 49 presses and urges the case 25 downward.

The wire 47 extending from the electric motor unit 43 supports the camera unit 23 in a suspended fashion against the dead weight thereof and the downward force by the pressure from the gas damper 49. As the wire 47 is fed out from the electric motor unit 43, the camera unit 23 moves downward, and as the wire 47 is wound up inside the electric motor unit 43, the camera unit 23 moves upward.

A pair of stoppers (L-shaped brackets) 52 is secured to the beam 50. As the upper end surface of the case 25 hits against the stoppers 52 when the camera unit 23 moves upward, the camera unit 23 is restricted to the upper limit position. An L-shaped bracket 54 is secured to the inner surface of the side wall of the case 25. When the camera unit 23 moves downward, the bracket 54 abuts on a stopper (L-shaped bracket) 53 fixed to the side shifter 32, the camera unit 23 is restricted to the lower limit position.

As shown in FIG. 4, the side shifter 32 is provided with upper-limit position and lower-limit position detection switches 55 and 56 for respectively detecting the storage position (lift-up position) and the lift-down position of the camera unit 23. A to-be-detected portion (protruding surface) which is detected by the upper-limit position detection switch 55 before the camera unit 23 reaches the upper-limit position is formed on the case 25. A to-be-detected portion (protruding surface) which is detected by the lower-limit position detection switch 56 before the camera unit 23 reaches the lower-limit position is formed on the case 25. In the present embodiment, the two detection switches 55 and 56 are provided at positions separated by predetermined distances from both side walls of the case 25. The to-be-detected portions (protruding surfaces) are formed by performing surface processing to have a level difference (undulations) along the up and down directions on end faces of both side walls (the back surfaces of the side walls).

At the time the camera unit 23 moves upward, as the detection contact of the upper-limit position detection switch 55 rides over the protruding surface (to-be-detected portion), the camera unit 23 is detected as having reached the upper-limit position. At the time the camera unit 23 moves downward, as the detection contact of the lower-limit position detection switch 56 rides over the protruding surface (to-be-detected portion), the camera unit 23 is detected as having reached the lower-limit position. That is, the individual detection switches 55 and 56 detect the upper end and lower end of the camera unit 23. The electric motor unit 43 is controlled based on detection signals from the individual detection switches 55 and 56. A dog may be attached to the case 25 as a to-be-detected portion.

A bare cable 57 is provided in the case 25. The electrical interconnections of the camera 26 are laid out through the bare cable 57. The electrical interconnections of the camera 26 are connected, together with other interconnections of the electric motor unit 43, the various kinds of switches 55 and 56, etc., to a controller 58 in the vehicle body 3 via a pulley (not shown) attached to the inner mast 17. In the present embodiment, the guide rails 40A and 40B, the rollers 41, the wire 47 and the gas damper 49 constitute the moving mechanism and the lifting mechanism.

A description will be given of the reason why the coupling structure using the wire 47 and the damper 49 as the lifting mechanism of the camera 26 was employed. It is necessary to prevent damages or the like of devices at the time of abnormality, such as a failure. That is, in case where the electric motor 44 does not work due to a failure of the power supply or the like and the camera unit 23 stays lifted down and cannot move up, if the forks 2 are lifted down to the lowest position, the camera unit 23 may collide with the floor. At the time the camera unit 23 collides with the floor, the wire 47 is loosened without acting against the impact and the gas damper 49 absorbs the impact, so that damages on the camera 26 can be avoided. As the wire 47 is just loosened and the impact is not transmitted to the electric motor 44, the electric motor 44 will not be damaged.

When there is rattling with respect to the housing 22 of the camera unit 23, for example, reduction in image quality by image blurring and a vibration-originated early failure in the camera 26 occur. For that reason, the position of the camera 26 is secured in the lift-up position and lift-down position of the camera unit 23. That is, in the lift-up position (storage position) of the camera unit 23, the drum 46 is locked by a worm gear in the gear box 45 of the electric motor 44 to lock the wire 47 pulled downward, thus fixing the camera 26 in an immovable state. In the lift-down position of the camera unit 23, the downward pressure from the gas damper 49 holds the camera 26 without rattling. As the camera 26 can surely be fixed in each of the lift-up position and the lift-down position, therefore, it is possible to suppress image blurring and the vibration of the camera 26.

If the descending speed of the camera unit 23 when the wire 47 is fed out from the electric motor unit 43 depends only on the dead weight of the camera unit 23, speedup is difficult to achieve. However, the gas damper 49 functions to speed up the descending speed of the camera unit 23. Therefore, the camera unit 23 is lifted down quickly by the gas damper 49. The ascending speed of the camera unit 23 depends on the winding-up speed of the wire 47 by the electric motor 44, and the descending speed thereof depends on the stroke speed of the damper 49, so that controlling both can make the ascending and descending speeds of the camera unit 23 nearly constant. To avoid the necessity of large power on the electric motor 44, the magnitude of the pressure of the gas damper 49 is set to the adequate value that matches with the aforementioned purpose and function.

Figure 9A:
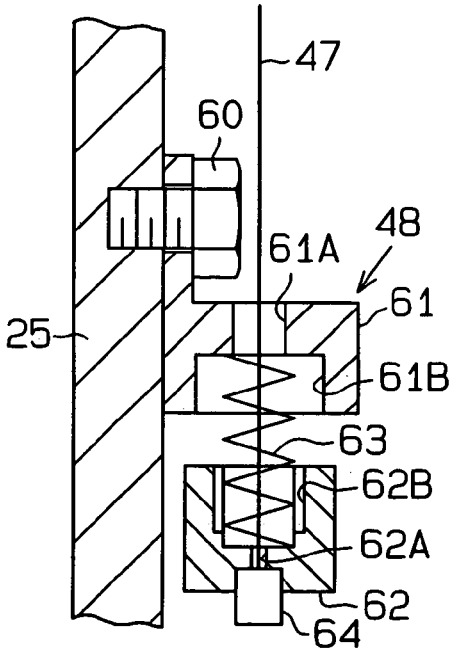
FIG. 9(*a*) is a cross-sectional view showing a state in which two holders are separated from each other.
Figure 9B:
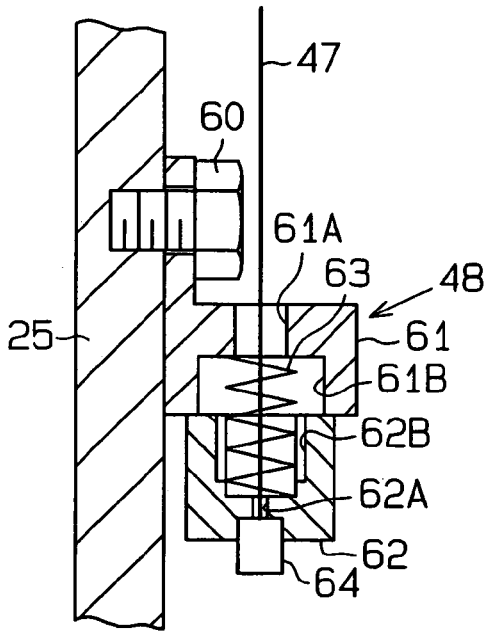

FIG. 9(*a*) and FIG. 9(*b*) are cross-sectional views of the tensioner 48 provided between the wire 47 and the case 25. The tensioner 48 includes a fixed holder 61, a movable holder 62 and a spring 63 intervened between both holders 61 and 62. The fixed holder 61 is fixed to the front side of the case 25 by a bolt 60. The movable holder 62 is so arranged as to face the fixed holder 61. The wire 47 penetrates through individual through holes 61A and 62A formed in the respective axial center positions of the fixed holder 61 and movable holder 62. A columnar stopper 64 fixed to the bottom end portion of the wire 47 is engaged with a recessed portion on the bottom wall of the movable holder 62. Both end portions of the spring 63 are stored in recesses 61B and 62B formed at the opposing locations of both holders 61 and 62. FIG. 9(*a*) shows the process in which the wire 47 is fed out to move the camera unit 23 down and a state in which the camera unit 23 is stopped. FIG. 9(*b*) shows the state of process in which the wire 47 is wound up to move the camera unit 23 upward.

As shown in FIG. 9(*a*), at the time the wire 47 is fed out and at the time the case 25 is stopped, the wire 47 is pulled downward by the spring 63 to give tension to the wire 47, even if the wire 47 is fed out slightly loosely. At the time the wire 47 is wound up, as shown in FIG. 9(*b*), the tension of the wire 47 compresses the spring 63 to make both holders 61 and 62 abut on each other so that the case 25 is pulled upward in the abutted state. Even when the case 25 descends or is stopped in which case the loosening of the wire 47 is likely to occur as compared with the case where the wire 47 is wound up, therefore, the tensioner 48 always keeps the wire 47 tensed. This makes it difficult to cause a problem, such as irregular winding of the wire 47 which would occur in the drum 46 of the electric motor unit 43 due to the loosening of the wire 47.

A description will now be given of the storage position and the lift-down position of the camera unit 23.

Figure 2:
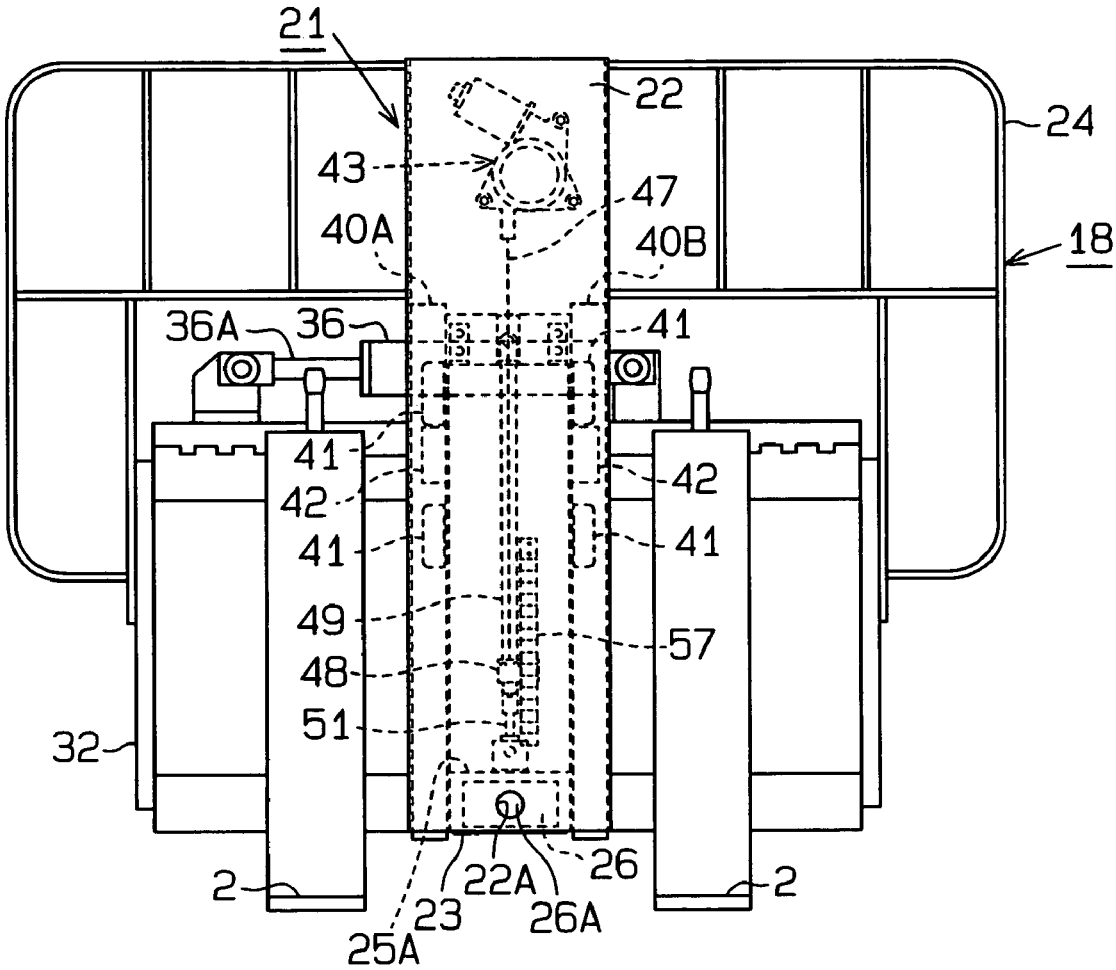
FIG. 2 is a front view of a carriage equipped with a camera lifting apparatus.

As shown in FIG. 2, the image pickup height of the camera 26 in the storage position, i.e., the height of the image pickup window 22A of the housing 22 is set to a position higher by a predetermined distance than the height of the top surface (load deposition surface) of the forks 2. At the time a cargo carrying work is carried out using the forks 2, it is necessary to position the forks 2 in the up and down directions and the vehicle's widthwise direction. It is therefore desirable that the image pickup position be the center portion of the two forks 2 in the vehicle's widthwise direction and be at approximately the same height as the height of the forks 2 (specifically, the load pickup portion extending frontward) in the up and down directions. If the camera unit 23 projects from the carriage 18, however, the interference with surrounding obstacles is concerned. In the present embodiment, therefore, the storage position is set in such a way that the lens section 26A is arranged at as close a height as the height of the forks 2 within the range where the camera unit 23 can be stored in the carriage 18 nearly completely.

That is, the forks 2 are positioned below, by a predetermined distance, the height of the bottom surface of the carriage 18 excluding the forks 2, such as the side shifter 32. Therefore, the position of the image pickup section 26A in the storage position is set above the top surface of the forks 2. The distance from the top surface of the forks 2 to the image pickup position lies within a range of 20 cm in the present embodiment. The image pickup section 26A is arranged at the center portion of the two forks 2 in the vehicle's widthwise direction. Therefore, an image picked up from the optimal angle to ascertain the position of the two forks 2 can be provided. In the storage position as a first image pickup position, therefore, the image of approximately the front of the forks 2 can be picked up. Here, the storage position lies in a range where it is regarded as "approximately the same height" as the forks 2 and it is regarded as the range of the "approximately the same height" if the elevation angle at the time of picking up the image of the distal end portion of the forks 2, for example, lies within a range of 10 degrees.

In case where the distance between the image pickup viewpoint in the storage position and the attachment in the up and down directions is unallowably long due to the differences in types of forks or an attachment, the storage position may be set in such a way that the camera unit projects from the carriage other than the attachment within the range above the bottom surface of the attachment. In this case, it is the attachment that hits against the floor, and the camera unit does not hit against the floor. Further, a structure may be taken in which image pickup is not carried out in the storage position where the camera unit 23 is nearly completely stored and it is moved down to the height of the attachment at the time of image pickup.

Without a load on the forks 2, the image of the work area directly in front of the forks 2 can be picked up through the image pickup window 22A even in the storage position. When there is a load on the forks 2, the load on the forks 2 interferes so that the image of the work area in front of the forks 2 cannot be picked up through the image pickup window 22A. At the time of positioning the forks 2, therefore, the camera unit 23 is placed in the storage position in load pickup mode in which there is no load on the forks 2, and the camera unit 23 is moved down to the lift-down position from the storage position only in load deposition mode in which there is a load on the forks 2. The lift-down position as a second image pickup position is a position in which the image of the work area can be picked up without being blocked by a load (pallet) on the forks 2 and a position located below the bottom surface of the forks 2 by a predetermined distance. It is desirable that the lift-down position be set in such a way that the elevation angle to pick up the image of the distal end portion of a load on the forks 2 exceeds, for example, 5 degrees. In the present embodiment, the moving distance from the storage position of the camera unit 23 to the lift-down position lies within a range of, for example, 20 to 40 cm. The longer the moving distance, the wider the view range of the work area. If the moving distance is too long, there would occur inconveniences such that it would take too much time to move the camera unit 23 and the storage of the camera unit 23 may not be completed before the forks 2 descends to the lowest lift-down position. The moving distance is therefore set in consideration of those points.

The electrical structure of the cargo handling operation aiding apparatus 20 will be described next.

Figure 10:
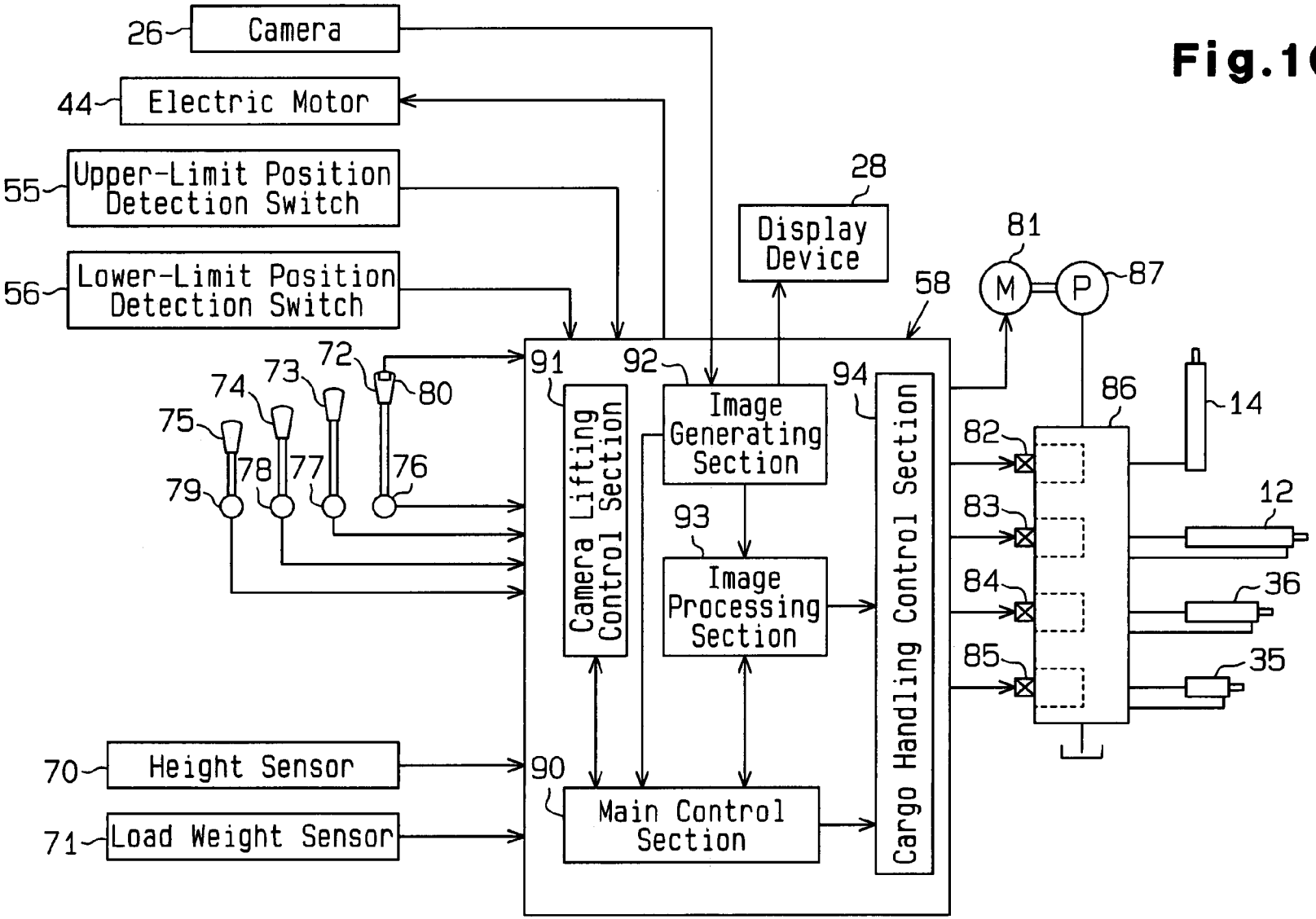
FIG. 10 is an electrical structural diagram of a cargo handling operation aiding apparatus.

As shown in FIG. 10, the controller 58 is connected with the camera 26, the electric motor 44 (electric motor unit 43), the upper-limit position detection switch 55, the lower-limit position detection switch 56, a height sensor 70 and a load weight sensor 71. The controller 58 is electrically connected to individual sensors 76, 77, 78 and 79, which respectively detect the operations of a lift lever 72, a reach lever 73, a side shift lever 74 and a tilt lever 75, and an operation button 80. The controller 58 is further electrically connected to the display device 28, a cargo handling motor 81 and the solenoids of a lift electromagnetic valve 82, a reach electromagnetic valve 83, a side-shift electromagnetic valve 84 and a tilt electromagnetic valve 85. The individual electromagnetic valves 82, 83, 84 and 85 are attached to an oil control valve 86 which constitutes a hydraulic circuit.

The height sensor 70 which is a limit switch attached to, for example, the mast 13 in a predetermined position detects the height of the forks 2. A sensor which can continuously detect the height of the forks 2 may be used for the height sensor 70. As a sensor capable of continuously detecting the height, there is, for example, a wire-winding type sensor which detects the feed-out amount of the wire from the amount of the rotation of the drum. A stroke sensor which detects the stroke length of the lift cylinder may be used for the height sensor 70. The height sensor 70 sends a detection signal to the controller 58 when detecting a predetermined height. In case of the sensor that continuously detect the height, the sensor sends a detection signal of a value according to the height of the forks 2 to the controller 58.

The load weight sensor 71 which is, for example, a pressure sensor, detects the weight of a load on the forks 2. The load weight sensor 71 sends a signal of a value according to the weight of a load on the forks 2 to the controller 58.

The operation button 80 is provided on, for example, the knob of the lift lever 72. The operation button 80 is manipulated by the driver when positioning control of the forks 2 to be discussed later is executed.

The cargo handling motor 81 drives a cargo handling pump 87. The driving of the cargo handling pump 87 feeds a hydraulic fluid to the oil control valve 86.

The individual electromagnetic valves 82, 83, 84 and 85 are used in the switch control of fluid paths in the oil control valve 86. The switching of the fluid paths by the electromagnetic valves 82, 83, 84 and 85 causes the lift cylinders 14, the reach cylinder 12, the side shift cylinder 36 and the tilt cylinder 35 to undergo hydraulic control, respectively. When receiving the detection signal from one of the sensors 76, 77, 78 and 79, the controller 58 supplies a current to the electromagnetic valve in the individual electromagnetic valves 82, 83, 84 and 85 which corresponds to the sensor that has made detection and drives the cylinder in the four cylinders 12, 14, 35 and 36 which is associated with the cargo handling operation.

The lift cylinders 14 are driven in accordance with the operation of the lift lever 72 and the forks 2 are lifted up or down according to the driving. The reach cylinder 12 is driven in accordance with the operation of the reach lever 73 and the reach operation of the forks 2 (mast assembly 11) is performed according to the driving. The side shift cylinder 36 is driven in accordance with the operation of the side shift lever 74 and the side-shift operation of the forks 2 is performed according to that driving. The tilt cylinder 35 is driven in accordance with the operation of the tilt lever 75 and the forks 2 are tilted according to that driving.

The controller 58 has a main control section 90, a camera lifting control section 91, an image generating section 92, an image processing section 93, and a cargo handling control section 94. The camera lifting control section 91 controls the electric motor 44 based on individual signals coming from the height sensor 70, the load weight sensor 71, and both detection switches 55 and 56.

The image generating section 92 generates image data based on an image signal input from the camera 26 and outputs the image data to the display device 28. The image picked up by the camera 26 based on the image data is displayed on the screen of the display device 28. The image processing section 93 performs an image recognition process based on the image data generated by the image generating section 92. In the image recognition process, an arithmetic operation to compute the positions of the forks 2 and an arithmetic operation to determine the direction (up and down and right and left) and the distance in and by which the forks 2 should be moved to position the forks 2 are performed. The image processing section 93 outputs control data (shift amount in each direction) to move the forks 2 in and by the acquired direction and distance to the cargo handling control section 94.

The cargo handling control section 94 performs control on the values of the currents to be supplied to the individual electromagnetic valves 82 to 85 and the drive control of the cargo handling motor 81. The cargo handling control section 94 controls the lift electromagnetic valve 82 and the side-shift electromagnetic valve 84 based on the control data from the image processing section 93 to drive the lift cylinders 14 and the side shift cylinder 36. The main control section 90, the camera lifting control section 91, the image generating section 92, the image processing section 93 and the cargo handling control section 94 are constituted by a microcomputer and a memory.

The image recognition process will be discussed next.

Marks for position detection are affixed to predetermined locations of the front sides of a pallet and a rack at the time of doing load pickup and load deposition. The controller 58 performs an image recognition process (e.g., a plate matching process) by processing an image picked up by the camera 26. Through the image recognition process, the controller 58 computes the position of a mark and computes the amounts of deviation of the positions of the forks 2 with respect to the pallet. The controller 58 moves up or down, or leftward or rightward in such a way as to compensate for the computed amount of positional deviation. As a result, the forks 2 are positioned to the normal positions matching with the insertion holes of the pallet by automatic control. The automatic control is not performed when the height of the forks 2 is low enough for the driver to be able to confirm that the forks 2 coincide with the insertion holes of the pallet. The automatic control is performed only when the forks 2 are positioned at or higher than a predetermined height. In the present embodiment, the threshold value of the height of the forks 2 to execute the automatic control is set to 2 meters.

The reason why the threshold value is set to 2 meters is to complete the elevation of the camera unit 23 to the storage position before the forks 2 reach the lowest lift-down position when moved to the lowest limit. That is, the height, Ho, of the forks 2 at which the elevation of the camera unit 23 for storage should start is given by the height $Ho=V1\times T1$ in case where the time needed for storage of the camera unit 23 is T1 seconds and the maximum descending speed of the forks 2 is V1. At or below a height H ($=Ho+\Delta H$) which is a predetermined distance added to the height Ho, it is so set that collision of the camera unit 23 on the floor is avoided by forcibly moving the camera unit 23 upward. In the present embodiment, the value of the height H is set to 2 meters and in case of 2 meters or lower, the camera unit 23 is forcibly stored. When the height of the forks 2 is small, i.e., in case where the height of the forks 2 is equal to or lower than 2 meters in the present embodiment, the driver can determine if the forks 2 have been adequately positioned with respect to the rack or a pallet, so that there is no problem arising in the cargo carrying work.

The controller 58 determines the presence/absence of a load on the forks 2 based on the detection signal from the load weight sensor 71. The controller 58 selects the load pickup mode when having determined that there is no load on the forks 2, and selects the load deposition mode when having determined that there is a load on the forks 2. In load pickup mode, the image pickup position of the camera unit 23 is set to the storage position. In load deposition mode, the image pickup position of the camera unit 23 is set to the lift-down position. In case where the height of the forks 2 exceeds 2 meters, the controller 58 lifts the camera unit 23 so as to be positioned in the storage position in load pickup mode and lifts the camera unit 23 down so as to be positioned in the lift-down position in load deposition mode. In load deposition mode where a load is placed on the forks 2 and when the forks 2 are to be lifted up to a position exceeding 2 meters from a position at or below 2 meters, for example, the descending of the camera unit 23 is started when the height of the forks 2 exceeds 2 meters.

In case where the height at which ascending and descending of the camera unit 23 are switched is a point of 2 meters, there is a possibility that chattering occurs at a height of approximately 2 meters. Therefore, it is practically desirable to set a hysteresis at a height at which ascending and descending of the camera unit 23 are switched. That is, the present embodiment employs a control logic which, specifically, ascends the camera unit 23 to the storage position from the lift-down position when the height of the forks 2 is equal to or lower than 2000 mm or in load pickup mode and descends the camera unit 23 to the lift-down position from the storage position when the height is equal to or higher than 2050 mm and in load deposition mode. To detect the heights of 2000 mm and 2050 mm, the height sensor 70 is placed at two locations of 2000 mm and 2050 mm.

When performing automatic control on the positioning of the forks 2, the driver operates the operation button 80 provided on the knob of the lift lever 72. A mark for pallet position detection is adhered or printed to a given location of the side of the pallet where there are the insertion holes. A mark for shelf position detection is adhered or printed to a predetermined location of the front side of each shelf plate which forms the shelf surface of the rack. When detecting the manipulation of the operation button 80, the controller 58 selects the automatic positioning mode and executes an image recognition process of the image picked up by the camera 26. In load pickup mode, the controller 58 identifies the pallet position detecting mark and computes the three-dimensional coordinates of the mark on the screen. In load deposition mode, on the other hand, the controller 58 identifies the shelf position detecting mark and computes the three-dimensional coordinates of the mark on the screen. If the controller 58 selects the load pickup mode or the load deposition mode, the three-dimensional coordinates (target coordinates) (Xo, Yo, Zo) of the mark in the normal position equivalent to the positioning target for the forks 2 on the image pickup screen are determined. The controller 58 computes the amount of shift of the forks 2 in the up and down directions and the right and left directions in order to match identified coordinates (X1, Y1, Z1) and target coordinates (Xo, Yo, Zo) of the mark with two-dimensional coordinates (XY plane coordinates) (X1 1) and (Xo o) in the up and down directions and the right and left directions in the three-dimensional space. The controller sends the computation result to the cargo handling control section 94. The cargo handling control section 94 controls the individual electromagnetic valves 82 and 84 to move the forks 2 by the shift amount in the computation result. As a result, the forks 2 are positioned to the target position according to the selected cargo carrying mode (load pickup mode or load deposition mode).

When it is the load pickup mode, the automatic positioning control is carried out in such a way that the forks 2 coincide with the insertion holes of the pallet. When it is the load deposition mode, the automatic positioning control is carried out in such a way that the forks 2 are placed at a height above the shelf surface by a predetermined distance (a value within the range of about 10 to 20 cm) in a state in which the widthwise directional center of the forks 2 matches with the widthwise directional center of the storage section of the rack.

Even if the forks 2 are positioned to the normal position, even slight tilting of a pallet (e.g., 2 or 3 degrees) does not allow the forks 2 to be inserted into the pallet. Therefore, the driver himself determines and performs the reach operation of inserting the forks 2 into the insertion holes of the pallet. Another automatic control employed is automatic horizontal control to control the angle of the forks 2 horizontal by detecting the tilt angle of the forks 2 by an angle sensor (e.g., a potentiometer).

Figure 3:
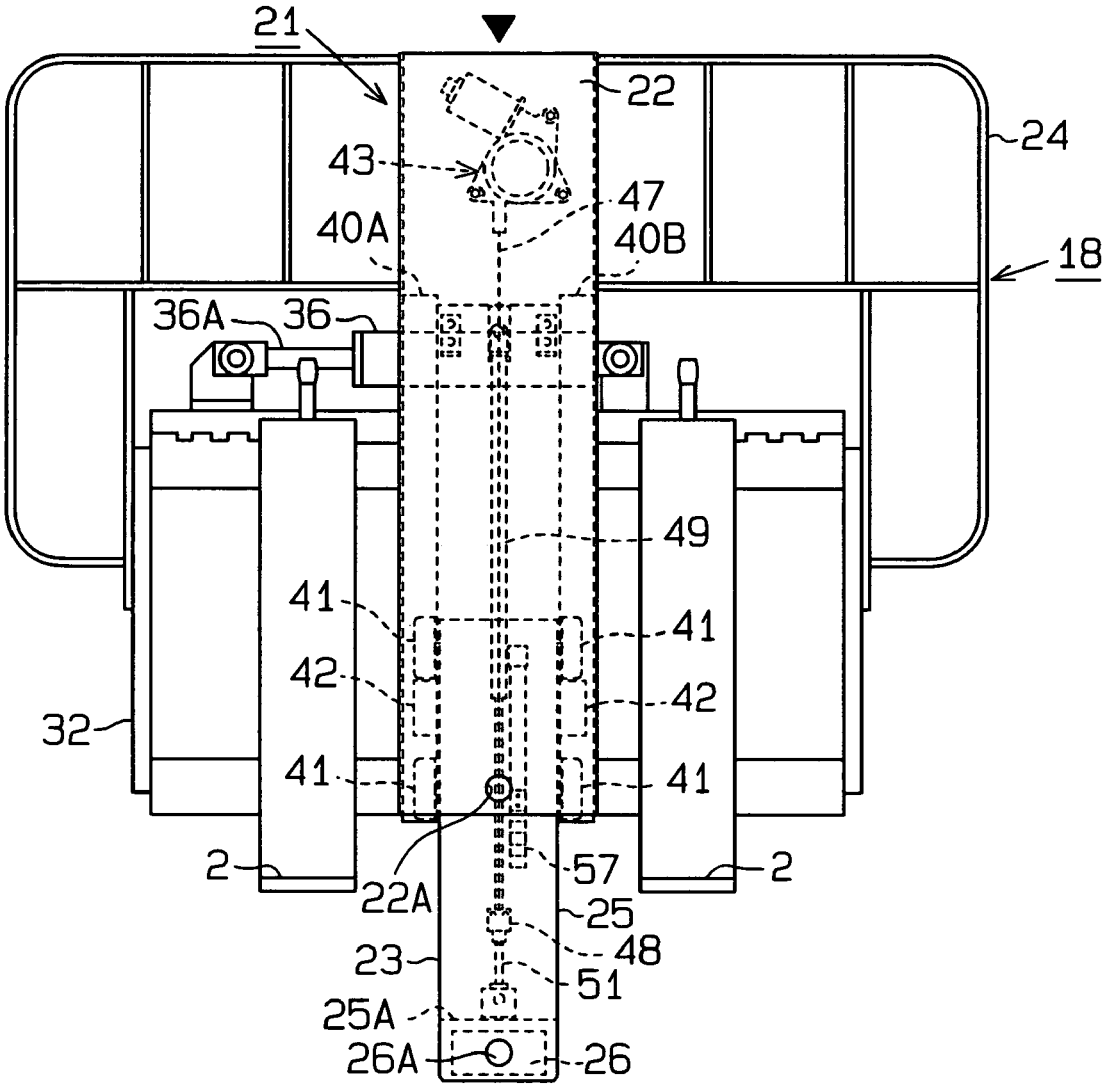
FIG. 3 is a front view of the carriage showing a camera unit moved down.
Figure 7:
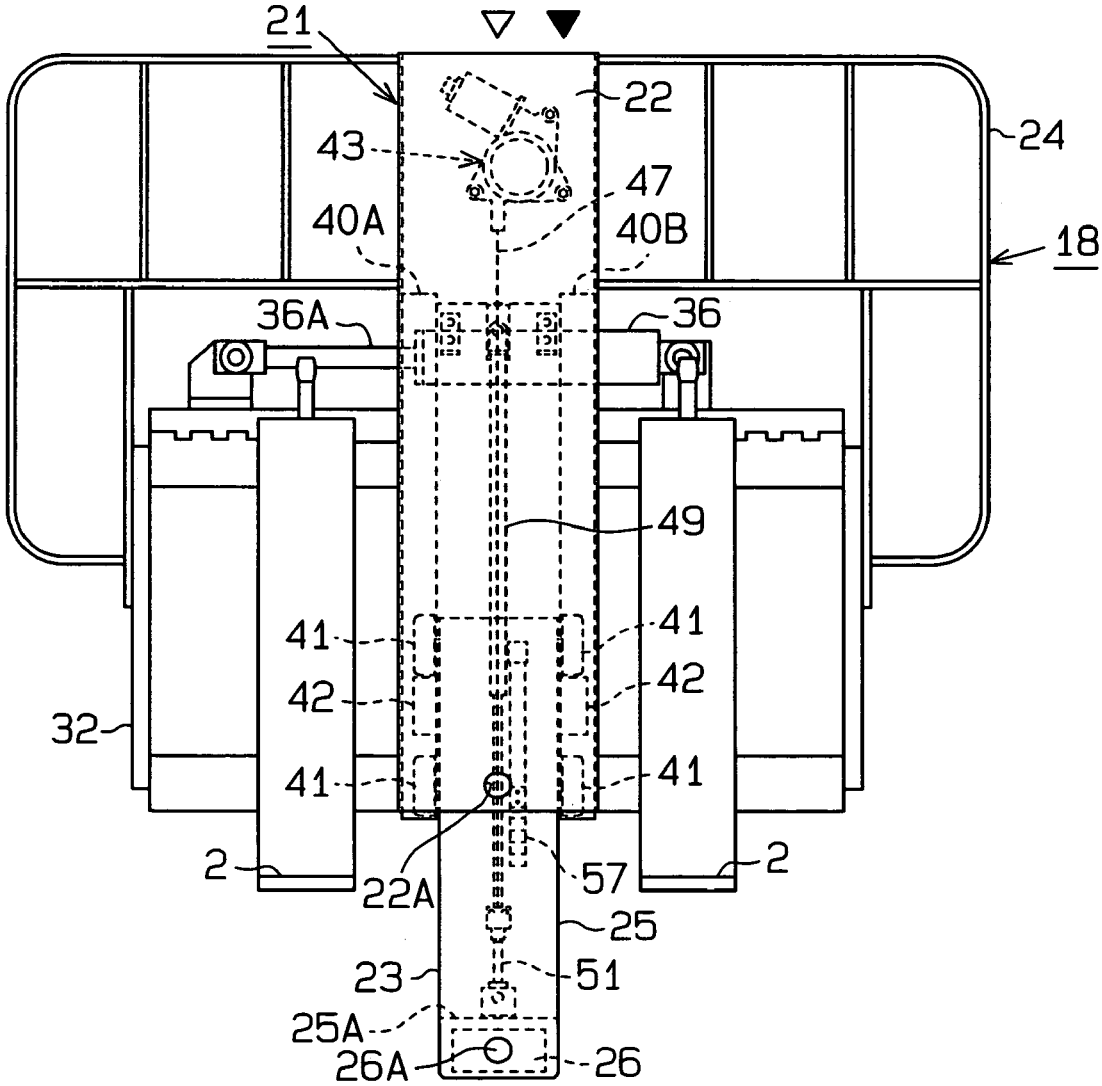
FIG. 7 is a front view of the carriage showing a side shift state.
Figure 8:
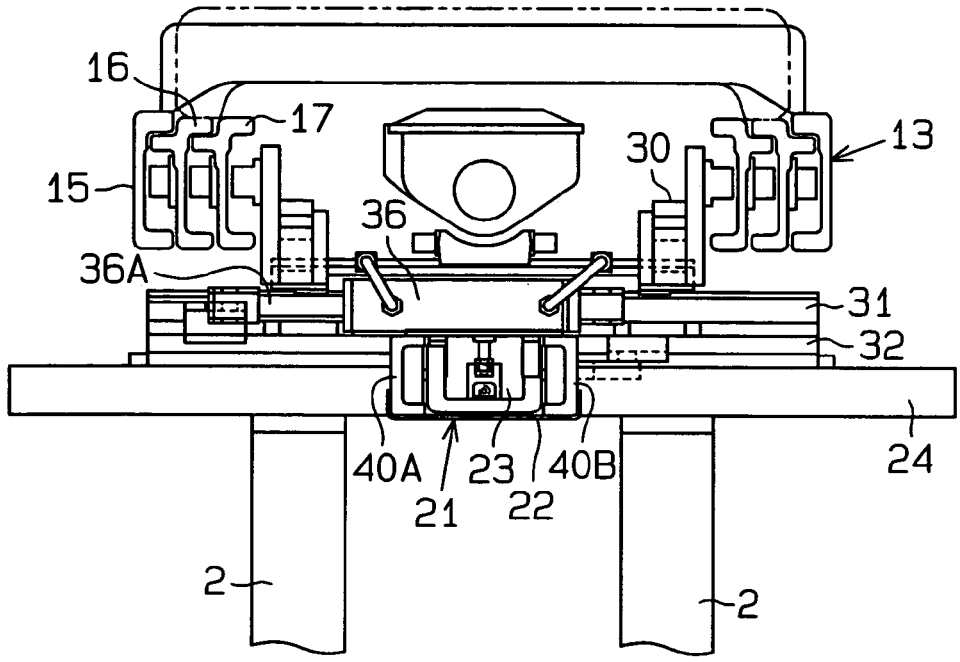
FIG. 8 is a partly cross-sectional view of a cargo handling apparatus.

As the camera lifting apparatus 21 is attached to the side shifter 32, the camera unit 23 moves together with the horizontal movement of the forks 2. That is, as shown in FIG. 3, in a state where the widthwise directional center of the side shifter 32 coincides with the widthwise directional center (position of the mark ▼) of the carriage 18 (lift bracket 30), the widthwise directional centers of the forks 2 and the camera unit 23 both match with the widthwise directional center of the carriage 18. When the side shifter 32 is moved, for example, rightward (leftward toward the sheet of the drawing), as shown in FIG. 7, the forks 2 and the camera unit 23 both move rightward together with the side shifter 32 and the widthwise directional centers of the forks 2 and the camera unit 23 both match with the widthwise directional center of the side shifter 32 even if the widthwise directional center of the side shifter 32 (position of the mark ∇) is shifted from the widthwise directional center of the carriage 18 (position of the mark ▼). Even if the forks 2 are shifted horizontally by the carriage 18 equipped with the side shift mechanism, therefore, it is possible to always pick up an image from the center position between the two forks 2. Therefore, the image pickup angle of an image to be shown on the screen of the display device 28 does not change when the forks 2 are moved horizontally by the side shift function. That is, because an image directly in front of the forks 2 is always picked up, the position of the forks 2 can be confirmed accurately from the picked-up image. Further, a computation in consideration of a difference in image pickup angle becomes unnecessary even in performing the image recognition process, so that the computation becomes simpler and the computation time can be shorter.

Only when necessary in load deposition mode, the camera unit 23 is moved down to secure as a wide image pickup area as possible. This can ensure image pickup of a work area in a wide range without being blocked by a load if placed on the forks 2. Therefore, the frequency of the deviation of the target mark off the image pickup range is low and control delay originated from the deviation of the mark off the image pickup range hardly occurs.

Because the camera unit 23 is moved down only when necessary in load deposition mode, the problem of hitting the moved-down camera unit 23 against the rack by an erroneous operation or the like and damaging it can be reduced as much as possible. As the camera unit 23 is moved down only when needed, the noise originated from the driving noise of the electric motor unit 43 at the time of descending the camera unit 23 can be reduced as much as possible.

The present embodiment has the following advantages.

(1) Because the present embodiment employs the mechanism that allows the electric motor unit 43 to elevate the camera unit 23 up and down, it is possible to lift the camera unit 23 up and down arbitrarily without being affected by the height of the forks 2. Further, the camera unit 23 is lifted down only when needed. It is therefore possible to reduce the problem of hitting the camera unit 23 in a state where it projects from the carriage 18 (in the lift-down position) against the surrounding objects (the rack or the like) by an erroneous operation as much as possible. Further, it is possible to prevent the camera 26 from being damaged for the camera unit 23 is automatically stored in the housing 22 when the forks 2 are moved down to the lowest position.

(2) The camera 26 is located at the distal end portion of the forks 2. Therefore, the image of the work area in front of the forks 2 can be picked up from the image pickup angle at which the driver can do a work most easily. This can shorten the working time for positioning the forks 2. In case where the image of a target is picked up obliquely in a camera position shifted leftward or rightward from the widthwise directional center position between the two forks 2, for example, the arithmetic operation to compute the positions of the forks 2 with respect to the target becomes complicated. Because a frontward picked-up image is used in the present embodiment, however, the arithmetic operation to compute the positions of the forks 2 with respect to the target is relatively simple. As the camera 26 is positioned in the widthwise directional center portion between the two forks 2, a wide area can be seen with the target set approximately at the center. As a result, the field of view on the screen of the display device 28 and the field of view for image processing can be secured wide.

(3) In case of the load deposition mode, the frontward field of view is secured by moving the camera 26 downward below the forks 2. Therefore, the driver can check the work area through the screen of the display device 28 even at the time of load deposition, and, what is more, assistance of automatic positioning control of the forks 2 is possible.

(4) The camera lifting apparatus 21 is attached to the side shifter 32. Therefore, the camera 26 is positioned at a position where the relative position to the forks 2 in the horizontal direction does not change always. Even when the forks 2 are shifted horizontally, therefore, the image from the camera 26 is not offset horizontally. This can allow the driver to do a cargo carrying work even when the forks 2 are located in any horizontal position while seeing an image always from the same image pickup angle, and the driver does not have awkward feeling. As the image pickup angle in front of the forks 2 does not change, the computation in the image processing is relatively simple.

(5) The structure that suspends the camera unit 23 via the wire 47 and urges it downward by the gas damper 49 is employed. Therefore, even if the electric motor unit 43 fails and the camera unit 23 does not move upward from the lift-down position at the time of descending the forks 2 to the lowest position, for example, the impact on the camera 26 when the camera unit 23 hits against the floor is absorbed by the gas damper 49. Therefore, damage of the camera 26 can be prevented. The impact is not transmitted to the electric motor unit 43 so that damage of the electric motor unit 43 can also be prevented.

(6) In the storage position of the camera unit 23, the drum 46 is locked by the worm gear in the gear box 45 of the electric motor 44 and the wire 47 is locked while being applied itself with tension. This can fix the camera 26 in an immovable state. In the lift-down position of the camera unit 23, the downward pressure from the gas damper 49 prevents the camera 26 from rattling even if not much tension is applied to the wire 47. As the position of the camera 26 is fixed, therefore, it is unlikely to cause a failure of the camera 26 and image blurring. The suppression of image blurring can keep a high precision of the positioning of the forks 2 based on the processing of the image from the camera 26.

(7) The moving speed of the camera unit 23 along the up and down directions is determined by the stroke speed of the gas damper 49. This can make the moving speed of the camera unit 23 approximately constant.

(8) Loosening of the wire 47 at the time of lifting the camera unit 23 down or stopping it can be suppressed by the tensioner 48. It is therefore possible to prevent irregular winding of the wire 47 in the drum 46 in the electric motor unit 43.

(9) High rigid and high load rail members are used for both guide rails 40A and 40B. Even if the driver hits the case 25 through an erroneous operation, therefore, damage or deformation or the like of the case will not occur.

Figure 11:
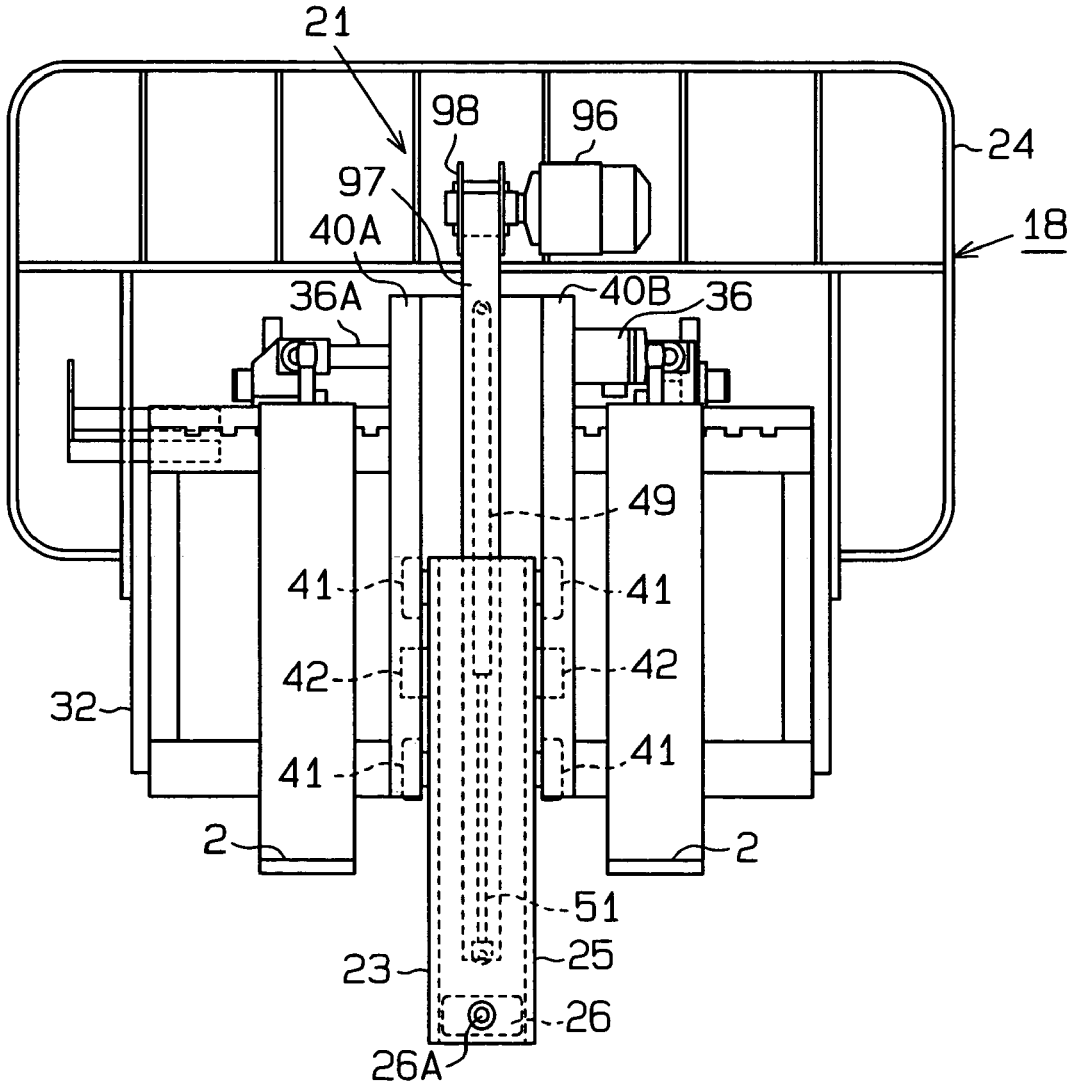
FIG. 11 is a front view of a carriage equipped with a camera lifting apparatus according to a second embodiment of the present invention.

Based on FIG. 11, a second embodiment of the invention will be described mainly on those portions which differ from the embodiment in FIGS. 1 to 10.

An electric motor 96 and a belt 97 are used for the suspending mechanism of the camera unit 23 in the present embodiment. A drum 98 is coupled to the output shaft of the electric motor 96 as an actuator. The camera unit 23 is supported in a suspended fashion on the lower end of the belt 97 wound around the drum 98. As the electric motor 96 is driven, the drum 98 is rotated forward or in reverse, and the winding and feed-out of the belt 97 is selectively carried out in accordance with the rotation of the drum 98. In accordance with the winding and feed-out of the belt 97, the camera unit 23 is guided to the guide rails 40A and 40B for lifting control. Although FIG. 11 shows only the mechanism portion of the lifting apparatus of the camera 26, the sensors and control contents or the like are the same as those of the embodiment in FIGS. 1 to 10. In this embodiment too, the basic principle of the mechanism is the same except for the replacement of the wire 47 with the belt 97, so that advantages similar to those of the embodiment in FIGS. 1 to 10 are obtained.

Based on FIG. 12, a third embodiment of the invention will be described mainly on those portions which differ from the embodiment in FIGS. 1 to 10.

A hydraulic cylinder 99 is used as an actuator in the present embodiment. The camera unit 23 is directly coupled to the distal end portion (lower end portion) of a piston rod 99A of the hydraulic cylinder 99. As the hydraulic cylinder 99 is driven, the piston rod 99A is protracted or retracted. In accordance with the protraction or retraction of the piston rod 99A, the camera unit 23 is lifted up or down. The hydraulic cylinder 99 is driven as the excitation/deexcitation control of an electromagnetic valve (not shown) provided in the hydraulic circuit is carried out by the controller 58, thus lifting the camera unit 23 up or down. Although FIG. 12 shows only the mechanism portion of the lifting apparatus of the camera 26, the sensors and control contents or the like are the same as those of the embodiment in FIGS. 1 to 10. In this embodiment too, the camera unit 23 can be lifted up or down to an arbitrary position regardless of the height of the forks 2. It is therefore possible to reduce, as much as possible, the frequency of interference of the camera unit 23 projecting from the carriage 18 with surrounding objects by an erroneous operation or the like. Even without the use of the flexible power transmitting member, advantages similar to those of the embodiment in FIGS. 1 to 10 can be obtained. Further, the hydraulic cylinder 99 is more resistive to an impact than the electric actuator so that it is unlikely to be damaged if an impact is transmitted to the piston rod 99A from the camera unit 23. Be noted that a pneumatic cylinder may be used as an actuator in place of the hydraulic cylinder.

Based on FIGS. 13 to 20(*d*), a fourth embodiment of the present invention will be described. The description of the present embodiment will be given only on those portions which differ from the embodiment in FIGS. 1 to 10, and the description of the other portions which are given the same numbers will be omitted.

An operation lever (multi lever) 161 is provided on an instrument panel located on the front side of the driver's seat 9 shown in FIG. 1. The operation lever 161 can ensure all the operations for the driving operation and cargo handling operation, and has a plurality of operation sections.

The operation lever 161 has a lever body 163 which tilts forward and backward of the vehicle along a slot 162 formed on the instrument panel. The lever body 163 is returned to the neutral position shown in FIG. 13 by the urging force of a spring (not shown) in a non-operational state. A grip 164 is attached to the upper end portion of the lever body 163 in such a way that it is tilted by an angle of about 30 degrees to 60 degrees to the vehicle's widthwise direction.

A knob 65 approximately cylindrical in shape is provided at the left end portion of the grip 164 in such a way as to be rotatable about an axial line C. A seesaw switch 66 is provided at the front end portion of the left portion of the grip 164. A cross switch 67 is provided at the back of the left portion of the grip 164. An activation switch 68 is provided at the front side of the left portion of the grip 164. The grip 164 is gripped by a right hand with the driver putting the right elbow on the instrument panel. With the grip 164 gripped, the knob 65 and the cross switch 67 are manipulated with the thumb, the seesaw switch 66 is manipulated with the index finger and the activation switch 68 is manipulated with the middle finger. FIG. 13*a* shows the cross switch 67 as seen from an A direction in FIG. 13.

Tilting the lever body 163 forward with the right hand holding the grip 164 moves the forklift 1 forward and tilting the lever body 163 backward moves the forklift 1 backward. When the knob 65 is turned upward by depressing a projection 65A formed on the knob 65 upward with the thumb, the forks 2 are lifted upward, and when the knob 65 is turned downward by pushing the projection 65A downward with the thumb, the forks 2 are lifted downward. Pushing the front end of the seesaw switch 66 with the index finger moves the mast assembly 11 forward, and pushing the rear end of the seesaw switch 66 with the index finger moves the mast assembly 11 backward. The cross switch 67 is operable in four directions, up and down and right and left. The tilt of the mast 13 is operated in accordance with the manipulation of the cross switch 67 in the up and down directions and the side shift is operated in accordance with the manipulation in the right and left directions. Pushing the upper end portion of the cross switch 67 with the thumb tilts the mast 13 forward and pushing the lower end portion of the cross switch 67 with the thumb tilts the mast 13 backward. Pushing the right end portion of the cross switch 67 with the thumb moves the forks 2 rightward and pushing the left end portion of the cross switch 67 moves the forks 2 leftward. The activation switch 68 is manipulated by the driver when automatic fork positioning control to be discussed later is performed.

As shown in FIG. 14, a rack 170 and a pallet 171 which are cargo handling targets are respectively affixed with marks M1 and M2 that are used as target positions at the time of positioning the forks 2 to the load pickup position or the load deposition position. The mark M1 affixed to the pallet 171 is for detection of the pallet position and is affixed to the center portion between two insertion holes 71A of the pallet 171. The mark M2 affixed to the rack 170 is for detection of the rack position and is affixed to the center portion of the front side of a shelf plate (beam) 172. The marks M1 and M2 are formed of figures of black and white patterns and their black and white patterns are inverted to each other. Based on the position of the mark M1 (or M2) picked up by the camera 26 on the screen, the amounts of horizontal (Y direction) and vertical (Z direction) deviations between the forks 2 and the cargo handling target (pallet 171 or the shelf plate 172) are computed and automatic positioning control of the forks 2 to automatically position the forks 2 to the cargo handling target is carried out in such a way as to cancel out the deviation amounts. The cargo handling target includes a load 173 placed on the pallet 171.

Figure 15:
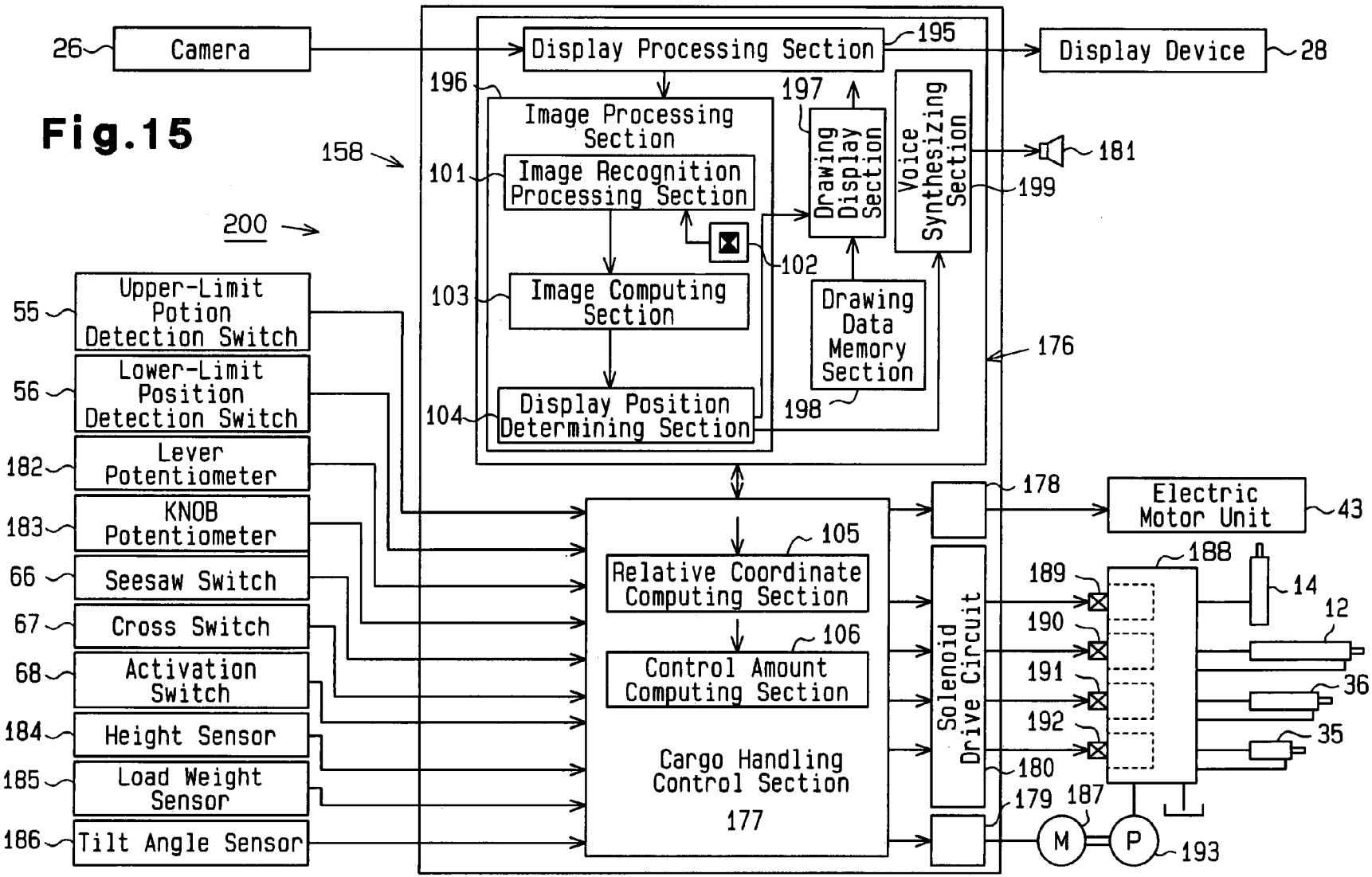
FIG. 15 is a block diagram showing the electrical structure of a cargo handling operation aiding apparatus.
Figure 16A:
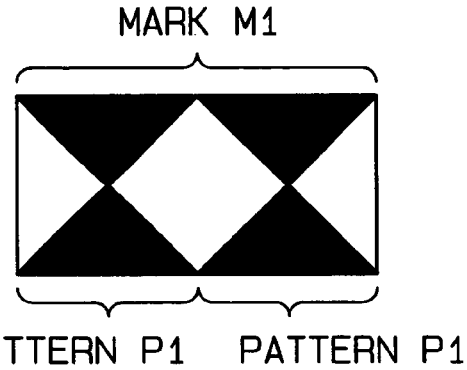
FIG. 16(*a*) is a diagram showing a mark M1.
Figure 16B:
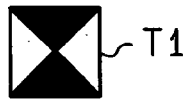
Figure 16C:
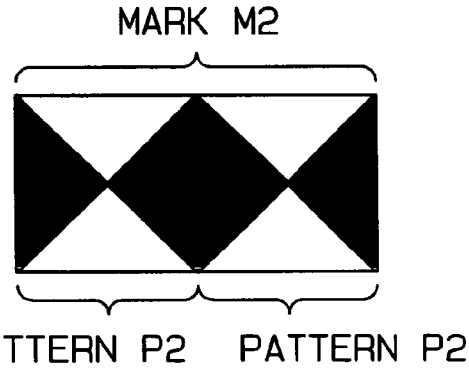
Figure 16D:
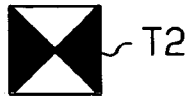

The electrical structure of a cargo handling operation aiding apparatus 200 will be described based on FIG. 15.

The cargo handling operation aiding apparatus 200 has a controller 158. The controller 158 has an image control section 176, a cargo handling control section 177, first and second drive circuits 178 and 179 and a solenoid drive circuit 180.

The camera 26 is connected to the input side of the image control section 176 and the display device 28 and a speaker 181 are connected to the output side. The image control section 176 displays an image picked up by the camera 26 on the screen of the display device 28 based on a video signal (image signal) input from the camera 26. The image control section 176 performs an image recognition process (template matching process) to recognize the image of the mark M1, M2 to acquire the positional coordinates of the mark M1, M2 in the screen coordinate system set on the screen of the display device 28. The image control section 176 performs geometric conversion based on the positional coordinate data to acquire the relative positional coordinates (real coordinate system) of the camera 26 and the mark M1, M2. Based on the relative positional coordinate data, the amounts of movement in the up and down directions and the right and left directions that are needed to position the forks 2 to the load pickup position or the load deposition position are computed. The speaker 181 notifies predetermined information by voice guidance.

The cargo handling control section 177 is connected with the upper-limit position detection switch 55, the lower-limit position detection switch 56, a lever potentiometer 182, a knob potentiometer 183 and the individual switches 66, 67 and 68 of the multi lever 161, a height sensor 184 as height detecting means, a load weight sensor 185 as cargo detecting means and a tilt angle sensor 186. The cargo handling control section 177 is connected with the electric motor unit 43 via the first drive circuit 178 and with a cargo handling motor (electric motor) 187 via the second drive circuit 179. Further, the cargo handling control section 177 is connected with the solenoids of individual electromagnetic valves 189 to 192 attached to an oil control valve 188 via the solenoid drive circuit 180.

Based on signals from the individual potentiometers 182 and 183 and the individual switches 66 and 67, the cargo handling control section 177 performs current value control of the individual electromagnetic valves 189 to 192 and drive control of the cargo handling motor 187. When a cargo handling pump (hydraulic pump) 193 is driven by the activation of the cargo handling motor 187, the hydraulic fluid is supplied to the oil control valve 188. Based on the signals from the multi lever 161, the electromagnetic valves 189 to 192 are controlled by the cargo handling control section 177 and the lift cylinders 14, the reach cylinder 12, the side shift cylinder 36 and the tilt cylinder 35 are hydraulically controlled. With this control, the elevation operation, reach operation, side shift operation and tilt operation of the forks 2 can be performed by the multi lever 161.

The cargo handling control section 177 performs lifting control of the camera unit 23 and automatic positioning control of the forks 2 in addition to the cargo handling control at the time of operating the multi lever 161. The automatic positioning control of the forks 2 is executed only at the time of a cargo carrying work at a high place where the forks 2 are positioned at or higher than a predetermined height (e.g., about 2 meters).

The height sensor 184 detects if the forks 2 are at or higher than a predetermined height. The height sensor 184 is a switch whose ON/OFF is switched at, for example, the predetermined height. The automatic positioning control of the forks 2 is executed only when the height of the forks 2 detected by the height sensor 184 is equal to or greater than a threshold value Ho. The height sensor 184 may be a sensor capable of continuously detecting the height of the forks 2. For example, a reel type height sensor which detects the amount of rotation of a reel from and on which a wire is fed out and wound in accordance with the elevation of the carriage 18 and an ultrasonic height sensor which detects the stroke of a cylinder from the measured time by which an ultrasonic wave that propagates in a fluid in the lift cylinders 14 is reflected at a piston and returned may be employed as the height sensor 184.

The load weight sensor 185 detects the weight (load weight) of the load 173 placed on the forks 2. In the present embodiment, the load weight sensor 185 is comprised of a pressure sensor which detects the hydraulic pressure in the lift cylinders 14. The load weight sensor 185 sends out a signal of a voltage value according to the weight of the load 173 on the forks 2 to the cargo handling control section 177.

The tilt angle sensor 186 detects a tilt angle with an angle at which the forks 2 are in a horizontal state (horizontal angle) as a reference. The tilt angle sensor 186 is comprised of, for example, a potentiometer. When automatic positioning control of the forks 2 is performed, the cargo handling control section 177 controls driving of the tilt cylinder 35 in such a way that the forks 2 are positioned horizontal based on a detected value from the tilt angle sensor 186.

The cargo handling control section 177 determines "no load" when a detected value W of the load weight sensor 185 is equal to or smaller than a threshold value Wo and determines "load present" when the detected value W exceeds the predetermined threshold value Wo. That is, the cargo handling control section 177 determines a cargo carrying work from the presence/absence of a load and determines a "load pickup work" in which the work is carried out with the forks 2 in a loadless state when $W \leqq Wo$ is satisfied and determines a "load deposition work" in which the work is carried out with the forks 2 in a load-present state when $W > Wo$ is satisfied. The cargo handling control section 177 sets the "load pickup mode" when determining that the cargo carrying work is a "load pickup work" and sets the "load deposition mode" when determining that the cargo carrying work is a "load deposition work". The process of setting the cargo carrying mode is performed every given time (e.g., several tens of msec.). As the detected value W of the load weight sensor 185 includes the weight component of the carriage 18 or the like, a detected value at the time of an empty load or a predetermined value added to that detected value is set for the threshold value Wo. For example, it is desirable to set the threshold value Wo so it is based on which "load present" is judged when only the pallet 171 is loaded.

The cargo handling control section 177 enters a standby mode for the activation of the automatic positioning control of the forks 2 only when it is determined that a condition (H>Ho) in which the height H of the forks 2 which is grasped from the detected value of the height sensor 184 exceeds the threshold value Ho (e.g., about 2 meters) is satisfied. When the activation standby mode is entered, the initiation of the lift control of the camera unit 23 for positioning the camera 26 in an image pickup position according to the cargo carrying work is permitted.

The camera unit 23 is placed in the storage position when the height H of the forks 2 is less than the threshold value Ho. When the height H of the forks 2 exceeds the threshold value Ho and the activation standby mode is entered, the camera unit 23 is placed in the storage position in "load pickup mode" and is placed in the lift-down position in "load deposition mode". When the height H of the forks 2 becomes equal to or lower than the threshold value Ho, the camera unit 23 is placed in the storage position.

The reason why the condition (H>Ho) for entering the activation standby mode is set is that ascending of the camera unit 23 to the storage position is completed before the forks 2 reaches the lowest lift-down position. The minimum height Hmin to start the upward lifting to surely store the camera unit 23 is expressed by the height $Hmin = V1 \times T1$, given that the time needed for storage of the camera unit 23 is T1 seconds and the maximum descending speed of the forks 2 is V1, and it is set in such a way that at or below the height Ho ($=Hmin+\Delta H$) which is obtained by adding a predetermined value to the height Hmin, so that collision of the camera unit 23 on the floor is avoided by forcibly moving the camera unit 23 upward. Although the automatic positioning control of the forks 2 is not executed at a height equal to or lower than the threshold value Ho, therefore, there is no problem arising in the cargo carrying work because when the height of the forks 2 is low, whether or not the forks 2 are positioned with respect to the rack or pallet can be determined accurately to some degree from the line of sight of the driver.

The following is the reason why the image pickup position is switched in accordance with the cargo carrying mode in the present embodiment. That is, at the time of a load pickup work (load pickup mode), the camera 26 is placed near the proximal end portion of the forks 2 as shown in FIG. 2 so that image pickup can be done from the viewpoint at approximately the same height as the insertion sections (load deposition portions) of the forks 2. In the "storage position" in which the camera 26 is placed near the proximal end portion of the forks 2, the camera 26 (camera unit 23) is stored in a position above the forks 2 so that it does not project below the forks 2 (i.e., the carriage 18). At the time of a load deposition work (load pickup mode), on the other hand, because the image of the work area cannot be picked up from the storage position due to the interference of a load on the forks 2, the camera 26 is placed in a position (lift-down position) below the forks 2 by a predetermined distance as shown in FIG. 3, so that image pickup can be done from the angle at which the load does not interfere with image pickup. In the "lift-down position," the camera 26 (camera unit 23) projects below the forks 2 (i.e., the carriage 18).

The automatic positioning control of the forks 2 is used in a cargo carrying work at a high place where the height H of the forks 2 exceeds the threshold value Ho. The driver manipulates the knob 65 of the multi lever 161 to lift the forks 2 up and roughly position the forks 2 with respect to the targeting cargo handling target 71 (72) while viewing the screen of the display device 28. At this time, when the height H of the forks 2 exceeds the threshold value Ho, the activation standby mode is entered, the camera unit 23 is held directly in the storage position when it is the load pickup mode and the camera unit 23 is lifted down to the lift-down position when it is the load deposition mode. In activation standby mode, positional detection through the image recognition process of the mark M1 (M2) affixed to the cargo handling target 71 (72) is carried out one after another. By the time rough positioning of the forks 2 is completed, the amount of deviation between the cargo handling target 71 (72) and the forks 2 has been computed. When the activation switch 68 is operated in this state, the automatic positioning control of the forks 2 to position the forks 2 with respect to the cargo handling target 71 (72) is initiated.

When receiving a signal indicative of the manipulation of the activation switch 68, the cargo handling control section 177 instructs the image control section 176 to start the automatic positioning control of the forks 2 via communications. The image control section 176 receives from the cargo handling control section 177 activation instruction data to initiate the image recognition process and cargo carrying mode data indicating whether it is the load pickup mode or the load deposition mode.

The image control section 176 has a display processing section 95, an image processing section 196, a drawing display section 197, a drawing data memory section 198 and a voice synthesizing section 199. The display processing section 95 synchronously sends out a video signal input from the camera 26 to the display device 28 in such a way that the image picked up by the camera 26 is displayed on the screen. The voice synthesizing section 199 performs voice synthesizing process for voice announce or the like and outputs a voice signal to the speaker 181. Image data from the display processing section 95 is input to the image processing section 196.

The image processing section 196 performs an image recognition process to compute the position of the mark M1, M2 on the screen and computes the positional relationship between the vehicle (forks 2) and the cargo handling target 71 (72) based on the computed position of the mark M1, M2. The image processing section 196 has an image recognition processing section 101, a template memory section 102, an image computing section 103 and a screen position determining section 104.

The image recognition processing section 101 performs an image recognition process by a pattern matching method using template data stored in the template memory section 102. The image computing section 103 computes the coordinates of the mark M1 (M2) in the screen coordinate system from the result of the image recognition process.

The display position determining section 104 performs a process of computing a drawing position to display a drawing on the screen of the display device 28. The display position determining section 104 computes, for example, the drawing position in which the contour of the mark M1, M2 is drawn and the drawing position of a target mark (moving target point) of the mark M1 (M2) to be the positioning target on the screen. When receiving a signal concerning the drawing position from the display position determining section 104, the drawing display section 197 reads drawing data corresponding to the drawing content from the drawing data memory section 198 and sends it to the display processing section 95. The display processing section 95 displays the image of the drawing on the display device 28 in such a way that it is overlapped at the designated drawing position on the picked-up image. The voice synthesizing section 199 generates voice guidance for the driver from the speaker 181, as needed, in synchronism with the drawing timing.

The image recognition processing section 101 performs a pattern matching process on the mark M1 when the cargo carrying mode recognized based on the cargo carrying mode data is the load pickup mode and performs a pattern matching process on the mark M2 when it is the load deposition mode. Stored in the template memory section 102 are a template T1 at the time the mark M1 is the target and a template T2 at the time the mark M2 is the target (see FIGS. 16(*a*) to 16(*d*) for both). At the time of executing a pattern matching process, the image recognition processing section 101 uses the template T1 when it is the load pickup mode and uses the template T2 when it is the load deposition mode.

FIG. 16(*a*) shows the mark M1 for pallet position detection and FIG. 16(*c*) shows the mark M2 for rack position detection. FIG. 16(*b*) shows the template T1 for the mark M1, and FIG. 16(*d*) shows the template T2 for the mark M2.

The mark M1 has a structure of two patterns P1 arranged, and the mark M2 has a structure of two patterns P2 arranged. Both patterns P1 and P2 have designs with the black and white inverted to each other. The templates T1 and T2 respectively have the same designs as the patterns P1 and P2.

Each pattern P1, P2 has a design separated into black and white colors by a plurality of boundary lines extending linearly and radially around one point. Each pattern P1, P2 in the present embodiment has a design separated into black and white colors by four areas defined by the two diagonal lines of a square as a boundary line. The contour line equivalent to the sides of the rectangular shape of the template is not a part of the design. Even if the size of the mark M1 (M2) to be displayed on the screen 28A changes in accordance with the distance between the mark M1, M2 and the camera 26, a pattern of the same size as the template T1, T2 always exists in the center portion of the picked-up patterns P1, P2. Through pattern matching using only a single template T1, T2, therefore, the image of the mark M1, M2 can be recognized.

Figure 17A:
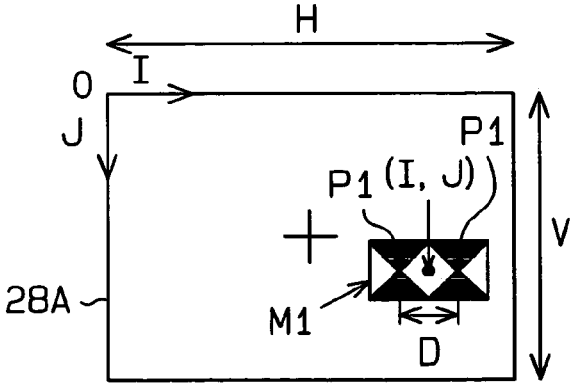
FIG. 17(*a*) is an explanatory diagram of a screen coordinate system.
Figure 17B:
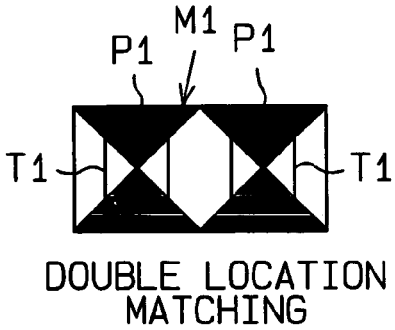

FIG. 17(*a*) shows the screen coordinate system set on the screen. In the screen coordinate system, the coordinates are treated pixel by pixel, H is the number of horizontal pixels of the screen 28A and V is the number of vertical pixels of the screen 28A. The image recognition processing section 101 performs matching with respect to the two patterns P1 constituting the mark M1 on image data at two locations using the corresponding template T1 and recognizes each pattern P1, as shown in, for example, FIG. 17(*b*). The image computing section 103 computes coordinates (I1, J1), (I2, J2) of the center points of the individual patterns P1 recognized by the image recognition processing section 101 and acquires a barycenter (I, J) of the mark M1 and a center distance D between the two patterns P1 based on those two coordinate values.

The data (I, J, D) computed by the image computing section 103 is sent to the cargo handling control section 177 from the image control section 176. The cargo handling control section 177 has a relative coordinate computing section 105 and a control amount computing section 106. The cargo handling control section 177 computes control amounts (the amounts of movement in the Y and Z directions) needed to position the forks 2 to the cargo handling target.

Figure 12:
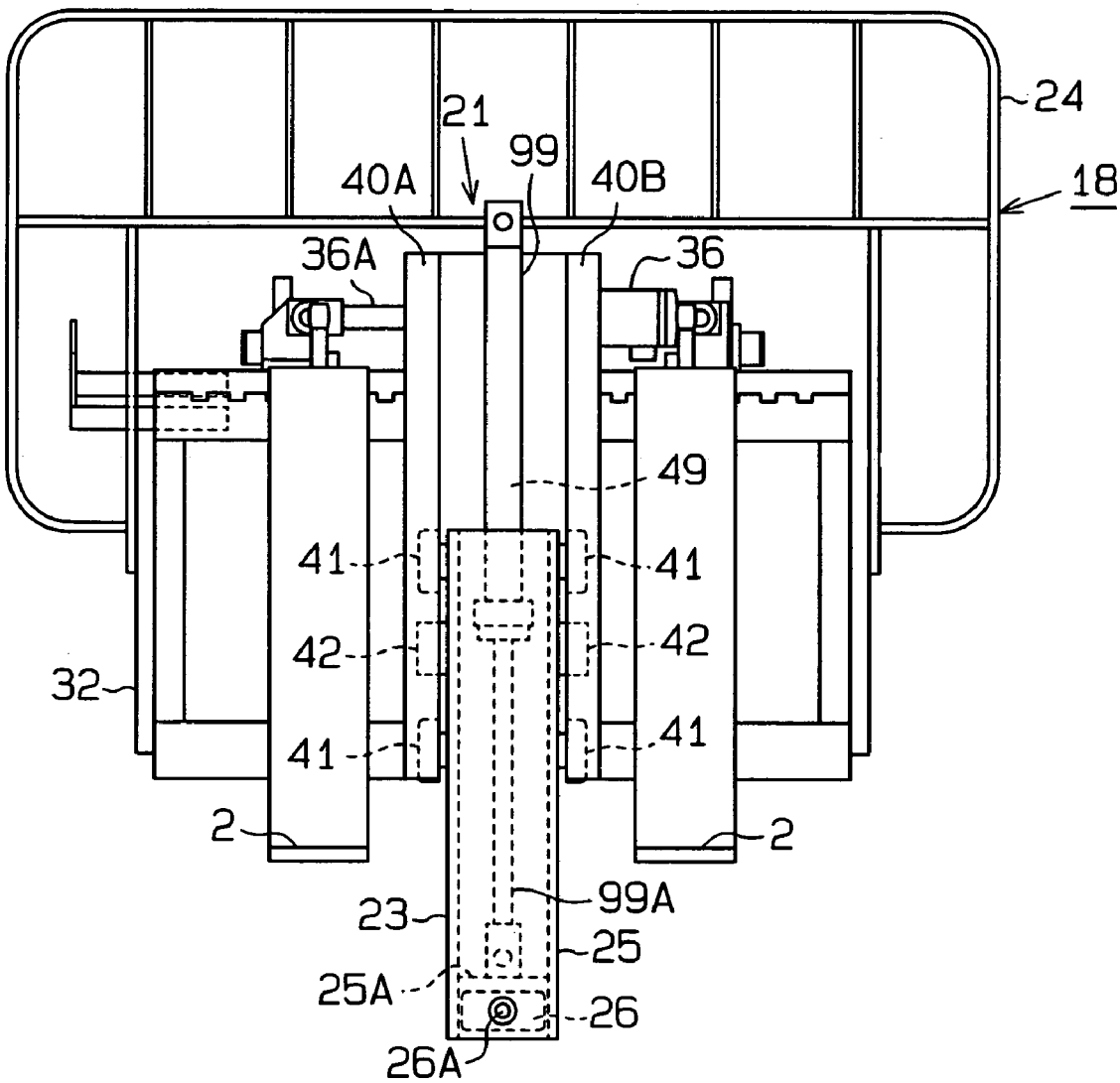
FIG. 12 is a front view of a carriage equipped with a camera lifting apparatus according to a third embodiment of the present invention.

The relative coordinate computing section 105 performs geometric conversion using the data (I, J, D) to compute three-dimensional relative positional coordinates (Xc, Yc, Zc) of the camera 26 and the mark M in real coordinate system (XYZ coordinate system) shown in FIG. 12. The coordinates (Xc, Yc, Zc) of the camera 26 with the barycenter of the mark M as the origin O are computed from the following equations.

$$Xc==-Hd/(2D\tan\alpha)$$

$$Yc=d/D(I-H/2)$$

$$Zc=d/D(J-V/2)$$

Here, "α" is a half of the horizontal angle of view of the camera 26, d is the center distance of the two patterns P1 of the mark M1 in the real coordinate system. Because H, V, α and d values are known values, the coordinates (Xc, Yc, Zc) are obtained if the I, J, and D values are computed. The positional deviation amount (control amount) of the forks 2 is computed based on the relative coordinates (Xc, Yc, Zc) of the camera 26 obtained in the real coordinate system. Xc is equivalent to a distance Xoc between the mark M and the camera 26. In the present embodiment, the Xc value is used to determine that the camera 26 has approached the mark M2 within a predetermined distance Xo at the time of a load deposition work. In the present embodiment, the camera 26, the image recognition processing section 101, the template memory section 102, the image computing section 103 and the relative coordinate computing section 105 constitute approaching detecting means for detecting the approach of the camera 26 with the cargo handling target 71 (72) and image processing means and position detecting means which detect the position of the cargo handling target 71 (72).

The relative coordinate computing section 105 computes the relative coordinates (Xc, Yc, Zc) of the camera 26 and the mark M1 (M2) based on the data (I, J, D). Here, the positional relationship between the camera 26 and the forks 2 is known and the positional relationship between the pallet 171 and the mark M1, M2 is known too. The control amount computing section 106 computes the individual amounts of movement (individual control amounts) of the forks 2 in the right and left directions (Y direction) and the up and down directions (Z direction) that are needed to position the forks 2 to the target position (the load pickup position or load deposition position) of the cargo handling target 71 (72) by using the relative coordinates (Xc, Yc, Zc) and the known information.

The cargo handling control section 177 sends out data about the individual amounts of movement of the forks 2 in the up and down directions and the right and left directions to the solenoid drive circuit 180. The cargo handling control section 177 controls the lift electromagnetic valve 189 and the side-shift electromagnetic valve 191 via the solenoid drive circuit 180 and controls the driving of the lift cylinders 14 and the side shift cylinder 36. As a result, the forks 2 are automatically positioned in the up and down directions and the right and left directions. Therefore, the forks 2 are positioned to the insertion holes 71A of the pallet 171 at the time of the load pickup mode, and are positioned to a target position above the shelf surface 72A by a predetermined distance at the time of the load deposition mode. In the present embodiment, the automatic positioning control is carried out only in the up and down directions and right and left directions of the forks 2 and the control in the forward and backward direction (reach direction) is left to the operation by the driver. The reach operation of the forks 2 may be automatically controlled. Each control section 176, 77 is comprised of a microcomputer and program data stored in a memory (ROM or the like).

Figure 18:
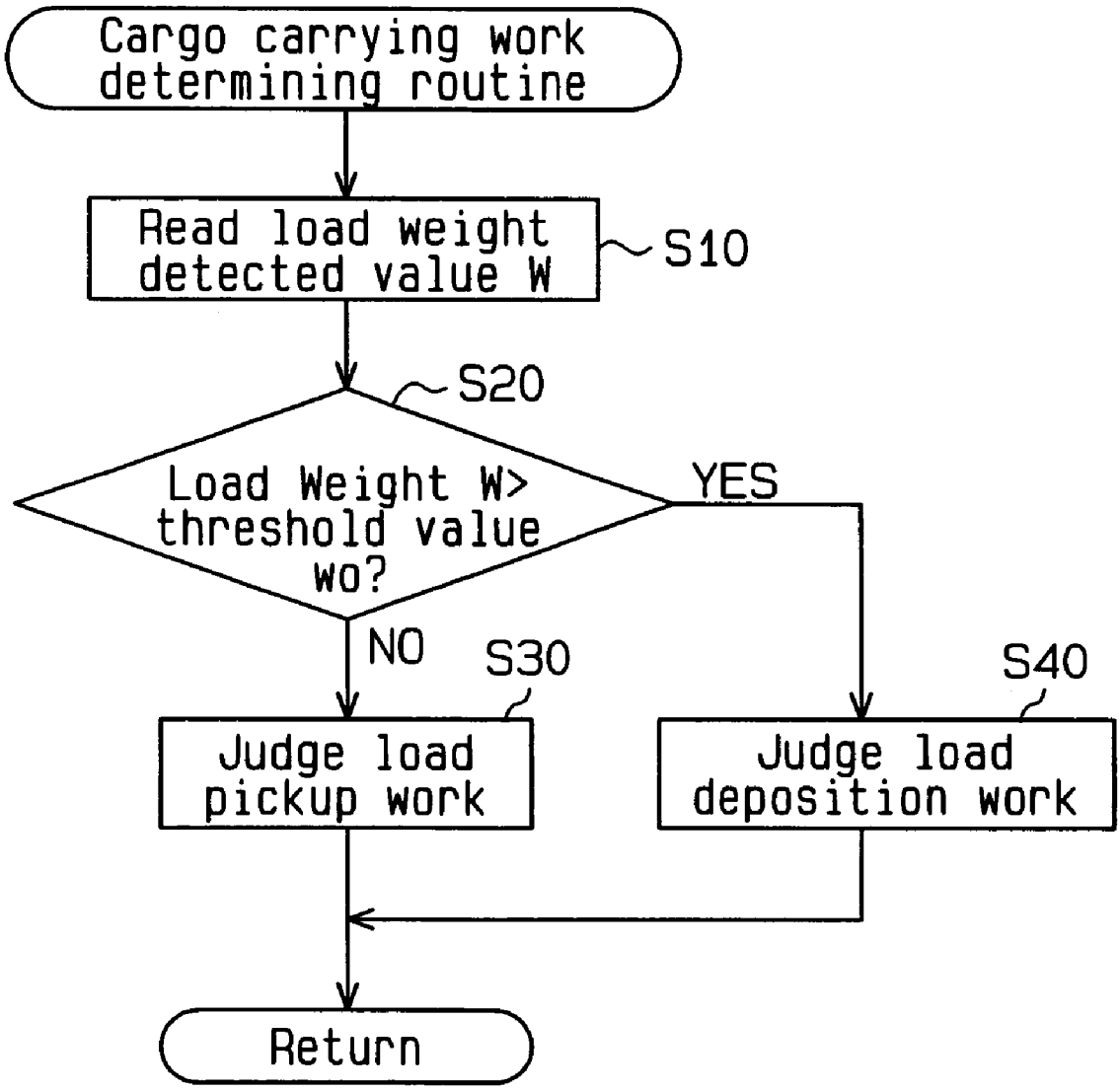
FIG. 18 is a flowchart of a cargo carrying work determining routine.
Figure 19:
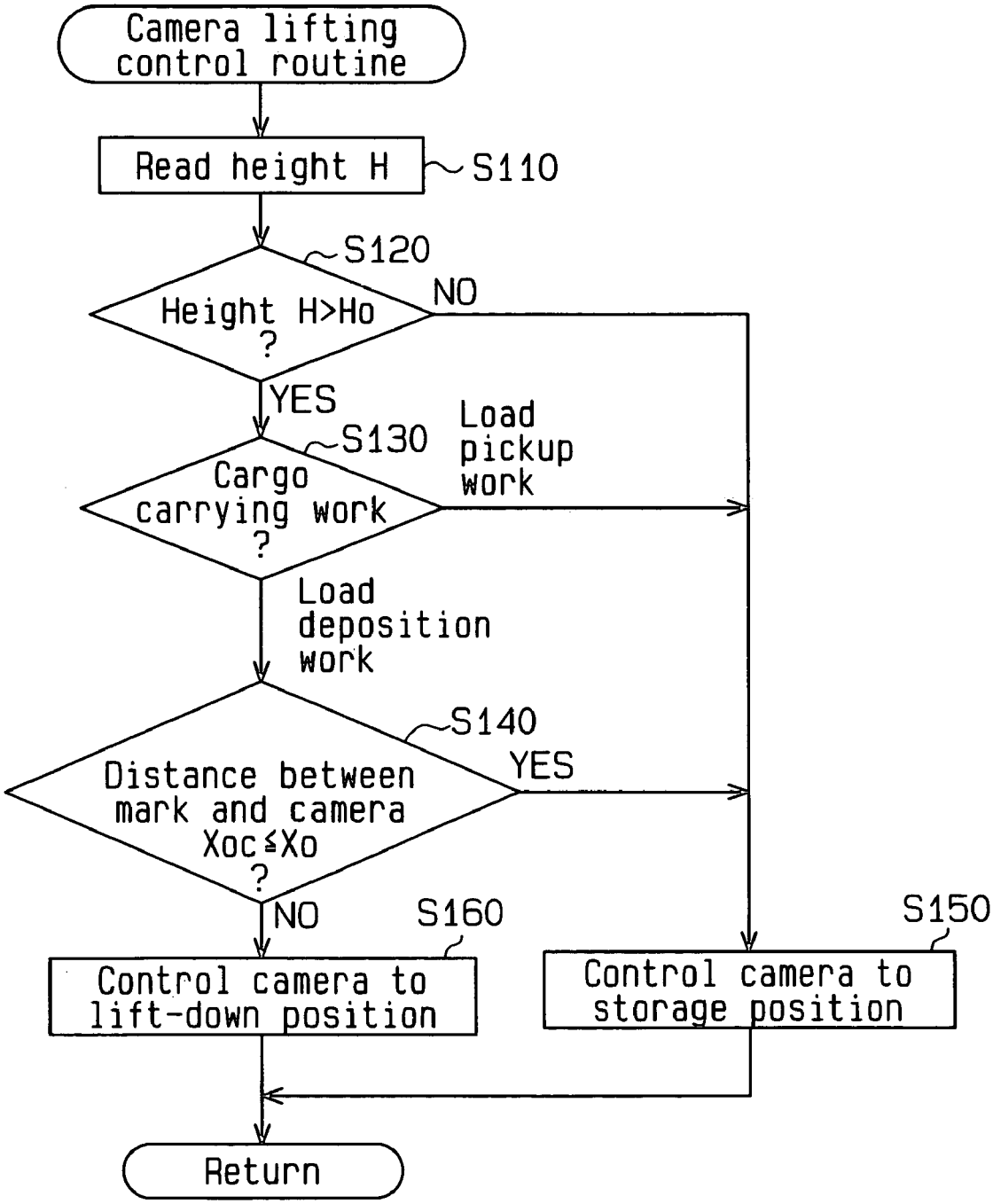
FIG. 19 is a flowchart of camera lifting control.
Figure 20A:
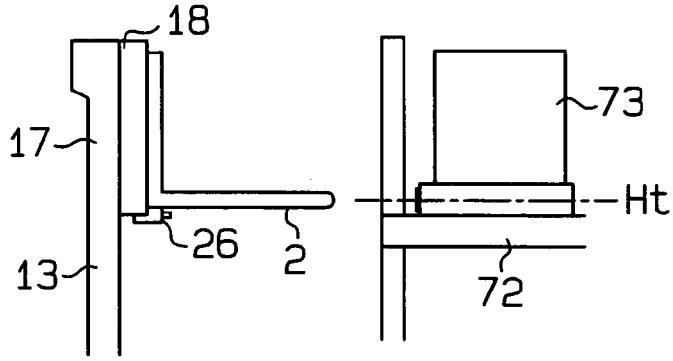
FIG. 20(*a*) is a diagram showing a state in which forks are arranged at a load pickup position.
Figure 20B:
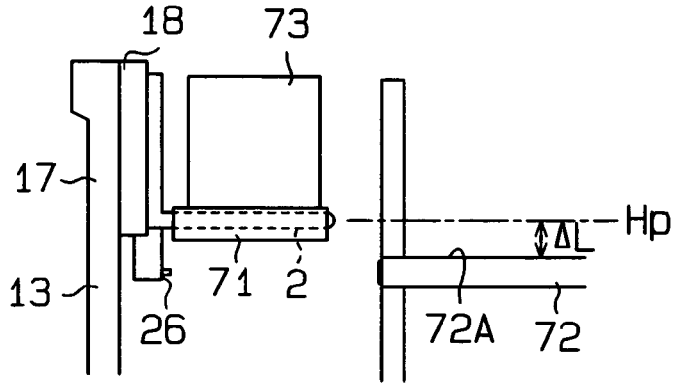
Figure 20C:
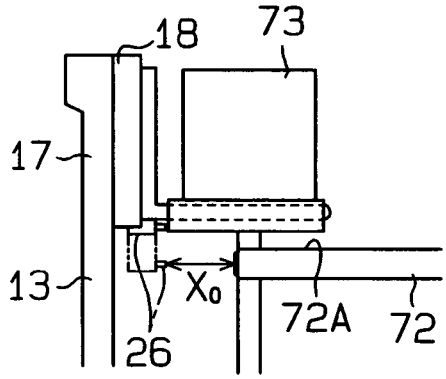
Figure 20D:
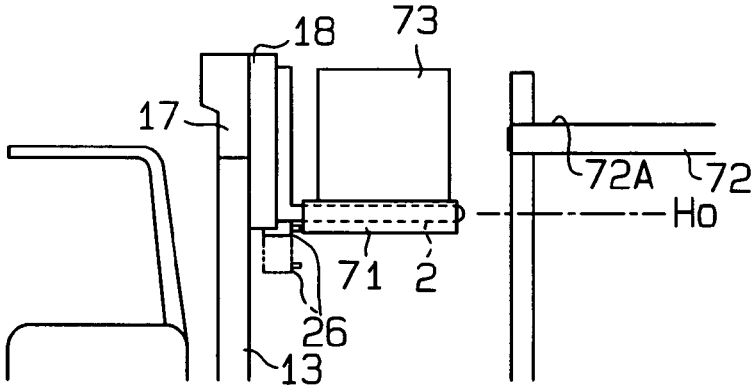

The cargo handling control section 177 stores individual programs of a cargo carrying work determining routine shown in FIG. 18 and a lifting control routine of the camera 26 shown in FIG. 19 in the memory. Each routine is executed by a CPU in the cargo handling control section 177. The CPU executes the lifting control of the camera 26 and automatic positioning control of the forks 2 in accordance with the result of the decision in each routine. In the routine shown in FIG. 18, the CPU determines whether a cargo carrying work to be conducted next is a load pickup work or a load deposition work. In the routine shown in FIG. 19, the CPU performs control to place the camera 26 in a position according to the type of the cargo carrying work and store the camera 26 (camera unit 23) in the storage position when predetermined conditions (height condition/approach condition) are satisfied. When the activation switch 68 is operated in a range where the height H of the forks 2 exceeds the threshold value Ho, the automatic positioning control of the forks 2 is executed.

The cargo carrying work determining routine will be described below based on FIG. 18.

First, in S10, the cargo handling control section 177 acquires the detected value from the load weight sensor 185.

In S20, the cargo handling control section 177 determines whether or not the load weight W exceeds the threshold value Wo. When the load weight W≦Wo is met, the process proceeds to S30 and when the load weight W>Wo is met, the process proceeds to S40.

In S30, the cargo handling control section 177 determines that the cargo carrying work to be carried out next is a "load pickup work".

In S40, the cargo handling control section 177 determines that the cargo carrying work to be carried out next is a "load deposition work".

The CPU always judges the contents of the cargo carrying work by executing this routine every interval of a predetermined time.

The lifting control routine of the camera 26 will be described below based on FIG. 19.

First, in S110, the cargo handling control section 177 acquires the detected value from the height sensor 184.

In S120, the cargo handling control section 177 determines whether or not the height H of the forks 2 exceeds the threshold value Ho (H>Ho). When the height H>Ho is met, the process proceeds to S130 and when the height H≦Ho is met, the process proceeds to S150.

In S130, the cargo handling control section 177 judges the cargo carrying work. When it is a load deposition work, the process proceeds to S140 and when it is a load pickup work, the process proceeds to S150.

In S140, the cargo handling control section 177 determines whether or not the distance Xoc to the mark M is equal to or smaller than a predetermined distance Xo (Xoc≦Xo). When Xoc≦Xo is satisfied, the process proceeds to S150 and when Xoc>Xo is satisfied, the process proceeds to S160.

In S150, the cargo handling control section 177 controls the electric motor unit 43 in such a way that the camera unit 23 is placed in the storage position.

In S160, the cargo handling control section 177 controls the electric motor unit 43 in such a way that the camera unit 23 is placed in the lift-down position.

FIGS. 20(*a*) to 20(*d*) illustrate cargo carrying operations for the lifting control of the camera 26 and the automatic positioning control of the forks 2. For example, FIG. 20(*a*) shows a state in which the forks 2 are placed in a load pickup position, and FIG. 20(*b*) shows a state in which the forks 2 are placed in a load deposition position. When the detected value (load weight) from the load weight sensor 185 is equal to or smaller than the threshold value Wo (W≦Wo), it is determined that the cargo carrying work to be done next is a "load pickup work (load pickup mode)". When the detected value (load weight) from the load weight sensor 185 exceeds the threshold value Wo (W>Wo), on the other hand, it is determined that the cargo carrying work to be done next is a "load deposition work (load deposition mode)".

When the height H of the forks 2 exceeds and the activation standby mode is entered, the lifting control of the camera 26 is started. The lifting control of the camera 26 is started with a signal input from the height sensor 184 when the height H of the forks 2 reaches the threshold value Ho as an instruction signal. At this time, it is determined, based on the detected value from the load weight sensor 185, whether or not the cargo carrying work to be done next is a load pickup work or a load deposition work. When it is the load pickup mode (load weight W<Wo), the camera 26 is placed in the storage position shown in FIG. 20(*a*). When it is the load deposition mode (load weight W≧Wo), on the other hand, the camera 26 is placed in the lift-down position shown in FIG. 20(*b*). At this time, the electric motor unit 43 is driven only when it is necessary to move the camera unit 23.

In load pickup mode, the cargo handling control section 177 reads the template T1, performs an image recognition process on the mark M1 to acquire the position of the mark M1, and acquire the relative coordinates (Xc, Yc, Zc) of the mark M1 and the camera 26 based on the data (I, J, D) obtained from that position. The cargo handling control section 177 instructs the control amounts in the up and down directions and right and left directions that are determined from the relative coordinates (Xc, Yc, Zc) to the oil control valve 188. As a result, the forks 2 are placed in a state (the position of a height Ht) facing the insertion holes 71A of the pallet 171 as shown in FIG. 20(*a*).

In load deposition mode, the cargo handling control section 177 reads the template T2, performs an image recognition process on the mark M2 to acquire the position of the mark M2, and acquire the relative coordinates (Xc, Yc, Zc) of the mark M2 and the camera 26 based on the data (I, J, D) obtained from that position. The cargo handling control section 177 instructs the control amounts in the up and down directions and right and left directions that are determined from the relative coordinates (Xc, Yc, Zc) to the oil control valve 188 in order to place the forks 2 in a load deposition position corresponding to the shelf plate 172. As a result, the forks 2 are placed at a height Hp positioned above the shelf surface 72A by a predetermined distance AL as shown in FIG. 20(*b*).

As shown in FIG. 20(*c*), after the forks 2 are positioned in the load deposition position, the mast 13 is reached for the load deposition work. At this time, the distance between the camera 26 and the mark M2 comes to or less than a predetermined distance Lo (e.g., a value in a range of 50 to 80 cm), the camera 26 is lifted up. As a result, the interference of the camera 26 with the shelf plate 172 is avoided. When the load 173 is placed on the shelf surface 72A, the load weight W becomes equal to or smaller than the threshold value Wo, it becomes the load pickup mode and the camera 26 is lifted up to be placed in the storage position. When the load pickup work is finished, the load weight W exceeds the threshold value Wo, it becomes the load deposition mode and the camera 26 is placed in the lift-down position.

At the time the forks 2 are lifted down in load deposition mode with the load 173 on the forks 2, as shown in FIG. 20(*d*), ascending of the camera 26 is started when the height H of the forks 2 becomes equal to or smaller than the threshold value Ho. The camera 26 is stored in the storage position before the forks 2 reaches the lowest lift-down position. Therefore, the camera 26 does not hit on the floor and is protected. In case of an empty load, the image of a forward area in the driving direction is picked up by the camera 26 placed in the storage position even during a transporting work (driving work) and the picked-up image is displayed on the screen 28A of the display device 28 as shown in FIG. 17(*a*).

The present embodiment has the following advantages.

(1) It is determined from the result of the detection by the load weight sensor 185 whether it is a load pickup work or a load deposition work and the camera 26 is placed in the storage position when it is the load pickup work and is placed in the lift-down position when it is the load deposition work. As the camera 26 is placed in the image pickup position according to the cargo carrying work, it is possible to pick up the image of a work area from the adequate image pickup position. As a result, an adequate image for doing the positioning of the forks 2 can be seen on the screen 28A or adequate image processing for supporting a cargo handling operation can be performed using that image data.

(2) As the camera unit 23 is lifted down only when necessary at the time of a load deposition work, the number of times the camera 26 is placed projecting from the carriage 18 can be reduced as much as possible. It is therefore possible to reduce the problem that the driver erroneously hits the camera unit 23 projecting from the carriage 18 (lift-down position) against a surrounding object (a rack or the like)

(3) In the storage position at the time of a load pickup work, image pickup can be done at the viewpoint of the camera as seen in the direction of insertion (load pickup direction (horizontal direction)) to the insertion holes 71A of the pallet 171 from nearly the same height as the insertion sections of the forks 2. Therefore, the insertion holes 71A of the pallet 171 can be seen from nearly the same viewpoint as the insertion sections of the forks 2 through the screen 28A of the display device 28. Accordingly, the positioning of the forks 2 that is performed through the screen 28A of the display device 28 can be carried out accurately and in a short period of time. In the lift-down position at the time of a load deposition work, on the other hand, the image of a work area can be picked up without being obstructed by the load 173 on the forks 2. In either cargo carrying work, therefore, the image of a work area can be picked up adequately.

(4) Image pickup can be done with the mark M1, M2 set in approximately the widthwise directional center by picking up the image of the front from the center position between a pair of forks 2 (the widthwise directional center position of the forks 2). Further, the camera 26 is positioned at a height near the proximal end portion of the forks 2 at the time of a load pickup work. Therefore, the camera 26 can pick up an image with the mark M1 set nearly in front and at nearly the center in the up and down directions. At the time of a load deposition work, the camera 26 is positioned below the forks 2 by a predetermined distance and can pick up an image with the mark M2 set nearly in front and at nearly the center in the up and down directions. It is therefore possible to see a wide area with the mark M1, M2 which is a target (object to be picked up) set nearly at the center. For example, the number of times the mark M1, M2 is set in the screen 28A at the time the forks 2 are roughly positioned visually or the like is increased.

(5) The threshold value Ho of the height H of the forks 2 at which the automatic positioning control of the forks 2 is executed is set to 2 meters. Even at the time of a load deposition work, the camera unit 23 is held stored up to the height of the threshold value Ho and the camera unit 23 is lifted down only after it exceeds the threshold value Ho. In this respect too, therefore, the frequency of occurrence of the projecting state of the camera 26 can be reduced. When the height H of the forks 2 is low, i.e., when the height H of the forks 2 is equal to or smaller than the threshold value Ho, whether or not the forks 2 are positioned with respect to the rack or pallet can be determined even from the line of sight of the driver, there is no problem arising in the cargo carrying work.

(6) Because the movement (upward lifting) of the camera unit 23 to the storage position is started when the height H of the forks 2 becomes equal to or smaller than the threshold value Ho, storage of the camera unit 23 can be completed surely before the forks 2 reaches the lowest lift-down position. As a result, collision of the camera unit 23 against the floor can be avoided surely. As the camera unit 23 is automatically stored at the time of moving the forks 2 to the lowest position, therefore, damages on the camera 26 can be prevented.

(7) If it is detected that the distance Xoc between the camera 26 and the shelf plate 172 (mark M2) comes closer within a predetermined distance Xo (Xoc≦Xo) when the mast 13 is reached for a load deposition work, the camera unit 23 is stored in the storage position. Therefore, an inconvenience such as the camera 26 interfering with the shelf plate 172 at the time of a load deposition work can be prevented.

(8) As the linear slide mechanism to slide the camera unit 23 in the up and down directions is used at the widthwise directional center of a pair of forks 2, the camera 26 can always be placed at the widthwise directional center portion of the forks 2 regardless of the elevation position of the camera unit 23. Therefore, it is easy to check the positioning of the forks 2 through the screen 28A and it is possible to pick up the mark M directly from the front, not obliquely, when the camera 26 picks up the image of the mark M. Therefore, an error is not easily produced in the process of detecting the position of the mark M and the precision of the positional detection of a cargo handling target, such as the pallet 171 or the shelf plate 172, can be improved.

(9) The process of determining a cargo carrying work is executed based on the detected value from the load weight sensor 185. Therefore, the load weight sensor 185 is harder to be damaged as compared with the structure that determines the presence/absence of a load by a contact type switch, such as a limit switch.

Based on FIGS. 21 and 22, a fifth embodiment of the present invention will be described below. Although the lifting mechanism (linear slide mechanism) which linearly lifts the camera unit 23 in the up and down directions is used in the embodiment in FIGS. 13 to 20(*d*), a lifting mechanism which lifts the camera 26 up and down by a rotary mechanism is used in this embodiment. In the present embodiment, the camera 26 picks up an image in front of the driving direction for the purpose of supporting a transporting work as well as a cargo carrying work and the image pickup position of the camera 26 according to the transporting work is set. Be noted that with regard to a cargo handling operation aiding apparatus 210, only those portions which differ from the embodiment in FIGS. 13 to 20(*d*) will be discussed.

Figure 21:
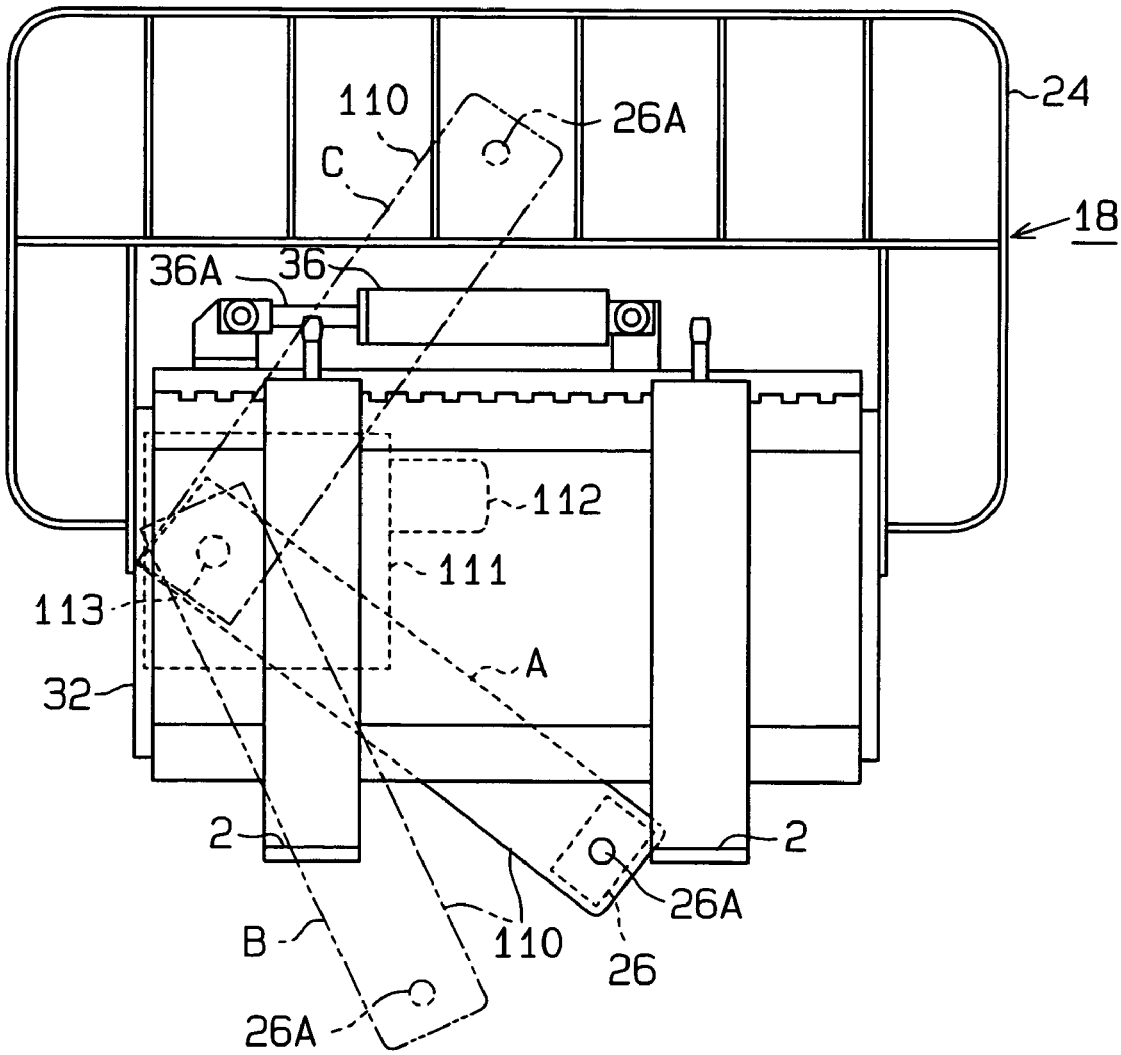
FIG. 21 is a front view of a carriage according to a fifth embodiment of the present invention.

As shown in FIG. 21, a support 110 having a predetermined length and provided with the camera 26 at its distal end is supported on the carriage 18 in such a manner as to be rotatable about the end portion of the side shifter 32. A gear box 111 and an electric motor (electric actuator) 112 as an actuator are assembled at the back of the side shifter 32. The proximal end portion of the support 110 is coupled to an output shaft 113 of the gear box 111. As the motor 112 is driven, the support 110 rotates about the proximal end portion. Three positions according to work contents are set for the rotational position of the support 110. The support 110 moves between a load-pickup image pickup position A (position indicated by a dotted line) where it is placed at the time of a load pickup work, a load-deposition image pickup position B (position indicated by a two-dot chain line) where it is placed at the time of a load deposition work, and a transporting position C (position indicated by a two-dot chain line) where it is placed at the time of a transporting work.

In the load-pickup image pickup position A, the camera 26 is placed at nearly the same height as the insertion sections of the forks 2. In the load-deposition image pickup position B, the camera 26 is placed below the forks 2 by a predetermined distance and the image of a work area can be picked up by the camera 26 without being obstructed by a load on the forks 2. Further, in the transporting position C, the camera 26 is placed in a position above the side shifter 32 and where it does not project from the carriage 18. In the load-pickup image pickup position A and the load-deposition image pickup position B, the camera 26 is projecting downward from the carriage 18. A standby position is set at a place where the camera 26 is lifted from the load-pickup image pickup position A to a position where it does not project from the carriage 18.

As the motor 112 is rotated forward, the support 110 is rotated clockwise in the diagram from the transporting position C, so that the camera 26 is lifted downward sequentially. As the motor 112 is rotated reversely, on the other hand, the support 110 is rotated counterclockwise in the diagram from the load-deposition image pickup position B, so that the camera 26 is lifted upward sequentially.

Figure 22:
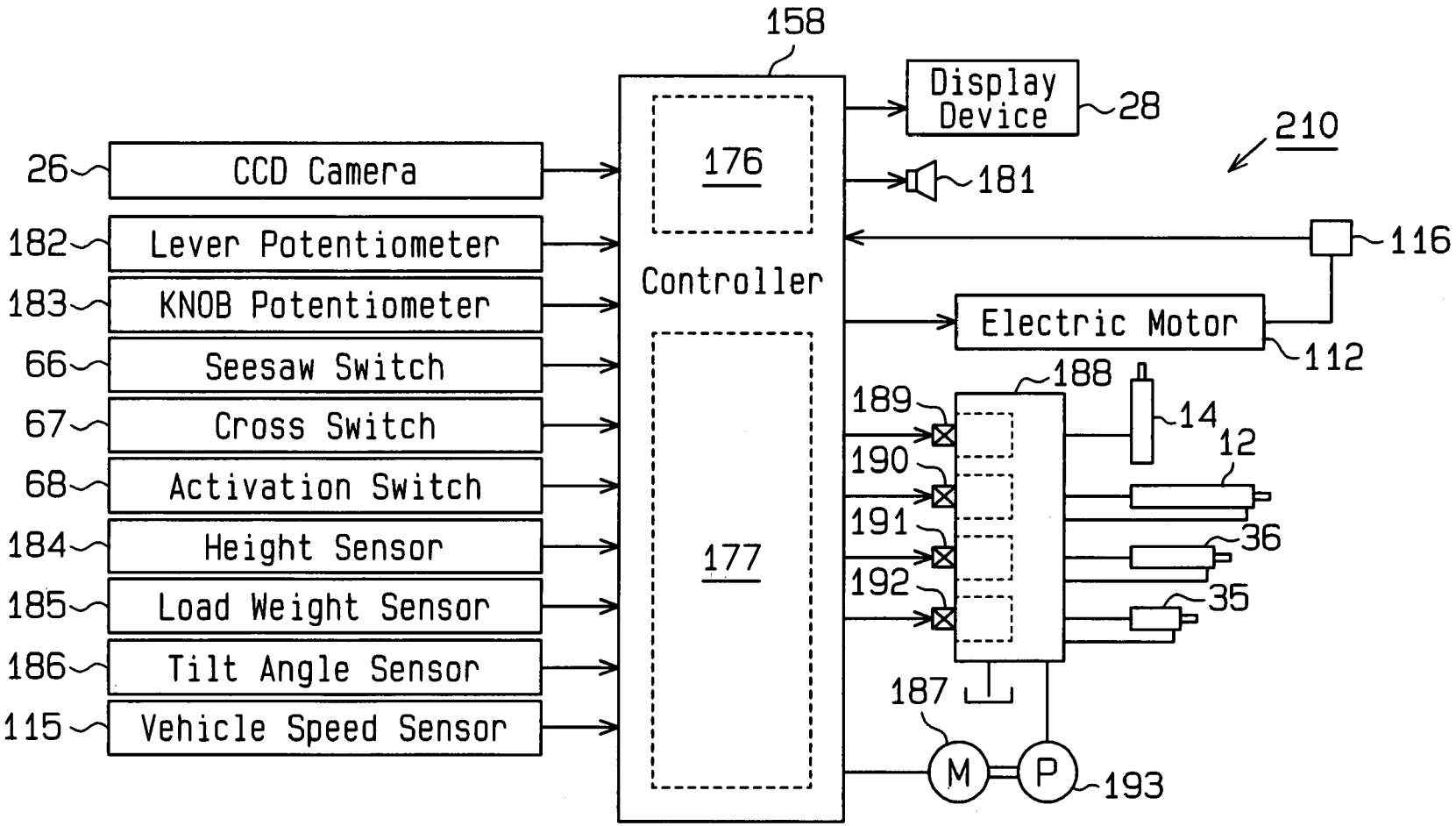
FIG. 22 is a block diagram showing the electrical structure of a cargo handling operation aiding apparatus in FIG. 21.

FIG. 22 shows the electrical structure of the cargo handling operation aiding apparatus 210. The cargo handling operation aiding apparatus 210 of the present embodiment has a vehicle speed sensor 115 and an encoder 116 added to the structure of the cargo handling operation aiding apparatus 200 in FIG. 15. The vehicle speed sensor 115 as state detecting means discriminates a transporting work. The encoder 116 detects the rotational angle of the support 110.

When having determined based on the result of detection by the load weight sensor 185 that it is a load pickup work, the controller 158 drives the electric motor 112 in such a way as to place the support 110 in the load-pickup image pickup position A. When having determined based on the result of detection by the load weight sensor 185 that it is a load deposition work, the controller 158 drives the electric motor 112 in such a way as to place the support 110 in the load-deposition image pickup position B. In this embodiment too, the support 110 is selectively lifted down to the load-pickup image pickup position A or the load-deposition image pickup position B according to the work after the height H of the forks 2 exceeds the threshold value Ho. When the distance Xoc between the camera 26 and the mark M1, M2 comes closer within a predetermined distance Xo, the controller 158 drives the electric motor 112 in such a way that the support 110 is rotated upward. As a result, the camera 26 is placed from the position A, B to the standby position where it does not project from the carriage 18.

The controller 158 acquires the rotational angle of the support 110 by counting detected pulses input from the encoder 116. As image data picked up by the camera 26 is subjected to an angle conversion process in accordance with the rotational angle, it is converted to an image in the normal direction. An image recognition process for detecting the position of the mark M1, M2 is executed based on image data after the angle conversion process. At the time of acquiring the coordinates of the camera 26 at that time, data of the rotational angle is used.

When the height H of the forks 2 becomes equal to or smaller than the threshold value Ho, the controller 158 drives the electric motor 112 in such a way that the support 110 in the load-pickup image pickup position A or the load-deposition image pickup position B is rotated upward. As a result, the camera 26 is moved up to the standby position where it does not project from the carriage 18. When a vehicle speed V based on the result of detection by the vehicle speed sensor 115 exceeds a predetermined speed, the controller 158 determines that the cargo carrying work is shifted to a transporting work. As a result, the support 110 is rotated upward from the standby position, placing the camera 26 in the transporting position C. During the transporting work, the image of a frontward area in the driving direction is picked up by the camera 26 from the transporting position and the picked-up image is displayed on the screen 28A. When the load being transported obstructs the camera 26, interfering with image pickup of the frontward area in the driving direction, the support 110 is further rotated counterclockwise in FIG. 21 and the image of the frontward area in the driving direction is picked up from, for example, the image pickup position where the camera 26 projects from the upper side portion of the carriage 18. When the forks 2 are moved down to a height less than a threshold value HL close to the lowest lift-down, the controller 158 may determine that the cargo carrying work has been completed and is shifted to a transporting work and may place the camera 26 in the image pickup position for the transporting work. In this case, the height sensor 184 constitutes the state detecting means.

Although the rotational center of the support 110 is set to the widthwise directional end portion of the carriage 18 in this embodiment, the rotational center of the support 110 may be set to, for example, the center portion of the carriage 18. For example, the position where the support 110 drops vertically to cause the camera 26 to project below the forks 2 is set as the image pickup position at the time of a load deposition work and the position where the support 110 is placed horizontally to make the camera 26 project from the side of the carriage 18 is set as the image pickup position at the time of a load pickup work. The position where the camera 26 projects from the side of the carriage 18 may be set as the image pickup position at the time of a transporting work.

The present embodiment has the following advantages.

(1) Because of the structure in which the rotary mechanism for lifting the camera 26 up and down by rotating the support 110 is used as the lifting mechanism and the camera 26 is placed to image pickup positions according to a load pickup work and a load deposition work respectively, the advantages (1) to (3), (5), (6) and (10) of the embodiment in FIGS. 13 to 20(*d*) are similarly acquired. It is to be noted however that although the camera 26 slightly projects from the carriage 18 in the image pickup position at the time of a load pickup work in the advantage (3), the amount of projection is very small so that there hardly is an interference with a surrounding object.

(12) At the time of a transporting work, the image of a frontward area in the driving direction is picked up by the camera 26 and can be seen on the screen 28A of the display device 28. Therefore, the image on the screen 28A is useful as a driving support (transportational support).

The present embodiment is not limited to the above-described one, but may be embodied in the following forms.

The moving displacement of the camera 26 is not limited to up and down elevations. For example, the structure may be such that the camera 26 is slid rightward and leftward (in the vehicle's widthwise direction) to be moved and placed in a plurality of image pickup positions. For example, a slide mechanism as a moving mechanism movable in the right and left directions (vehicle's widthwise direction) is provided on the carriage 18. The camera 26 is movable along the slide mechanism between the widthwise center position between a pair of forks 2 and an image pickup position at the time of a load deposition work where it projects from the side of the carriage 18.

Although the placing position (image pickup position) of the camera 26 is fixed to one location for each type of cargo carrying works in the individual embodiments in FIGS. 1 to 22, the placing position (image pickup position) of the camera may be continuously varied with respect to a single cargo carrying work. For example, the placing position of the camera may be changed in accordance with the size of a load on the forks. As the load is lengthy in the forward and backward direction, the image pickup field of view of the camera is obstructed. The longer a load is in the forward and backward direction, therefore, the lower the camera is moved down. That is, a mechanism is separately prepared which computes an image pickup position where the image of a target location can be picked up without being obstructed by a load on the forks at the time of a load deposition work and the lift-down amount (projection amount) can be minimized. The controller drives the actuator in such a way that the camera is moved to the image pickup position computed by this mechanism. This can make the lift-down amount of the camera from the storage position variable with the minimum projection amount of the camera position (image pickup position) at the time of a load deposition work. To acquire the image pickup position at which a target location can be picked up without being obstructed by a load on the forks, the length of the load in the forward and backward directions is obtained by using, for example, a length measuring sensor, and the longer the length of the load in the forward and backward directions is, the greater the lift-down amount of the camera is made. A method may be employed which recognizes the area of a load in the screen area by performing image processing on image data, the image pickup position where the image of a mark can be picked up without being obstructed by the load is acquired through geometrical computation from the current camera position and the area on the image obstructed by the load, and the lift-down amount of the camera from the storage position is then obtained. It is possible to determine the lift-down position of the camera based on data about the length of a load which is input by, for example, a key operation by the driver.

At the time of a load deposition work, as the camera 26 is moved downward and positioned as much as possible, it is possible to secure a wider image pickup field of view so that the mark M1, M2 can be found earlier when the forks 2 are lifted upward, thus realizing speedy control. In view of this point, the placing position of the camera 26 may be made variable in accordance with the height H of the forks 2, which is detected by the height sensor, in such a way that the higher the height of the forks 2, the lower the camera 26 is placed. It is to be noted however that the condition should be such that the lift-down position of the camera 26 is such a lift-down amount as to be able to store the camera 26 sufficiently before the forks 2 reach the lowest lift-down position even if the forks 2 are moved downward at the maximum speed.

The types of cargo carrying works for which the placing position of the camera is to be determined are not limited to two: a load pickup work and a load deposition work. For other industrial vehicles than a forklift, the position of the camera can be set in accordance with the type of a cargo carrying work that the cargo carrying apparatus handles; for example, the types of cargo carrying works that the cargo carrying apparatus handles may be three or greater.

The use of the camera 26 is not limited to the one for picking up the image of a work area for the purpose of image processing. The camera 26 may pick up the image of a work area only for a driver to see the work area on the screen of the display device.

In case where the camera 26 picks up the image of a work area for the purpose of image processing, the image processing is not limited to image processing for recognition of the position of a cargo handling target.

In case where the purpose of image pickup by the camera 26 is for an image recognition process of a cargo handling target, the purpose of the image recognition process is not limited to the one for automatic positioning control of the forks 2. For example, a guide display for positioning may be displayed on the screen of the display device 28 based on the result of the image recognition process. Further, a voice guidance may be given through the speaker 181 based on the result of the image recognition process. The displayed guidance may instruct the direction in which the forks 2 should be moved to be positioned or may display a target indication (target mark) in a moving target position.

The marks M1 and M2 are not limited to the radial figures, but may take simple figures, such as a circle (●), triangle (▲) or a rectangle (■). In this case, multiple templates should be prepared depending on pattern matching. Further, an image recognition method other than pattern matching may be employed to detect the position of a cargo handling target.

The location of the provision of the camera 26 is not limited to a portion on the carriage 18. For example, the camera 26 may be provided liftable with respect to the inner mast 17. If the mast 13 is of a telescopic type, the positional relationship between the carriage 18 and the inner mast 17 is always set steady in a position higher than the position where the carriage 18 reaches the top most end position of the inner mast 17. Even if the camera 26 is provided on the inner mast 17, therefore, the positional adjustment of the camera 26 with respect to the forks 2 becomes relatively simple. The camera 26 is provided on the inner mast 17 in such a way as to be lifted up and down between the lift-up position where it is positioned at approximately the same height as the forks 2 and the lift-down position where it is lifted downward by a predetermined distance from the forks 2 with respect to the forks 2 (forks' insertion sections) when the carriage 18 reaches the topmost end position of the inner mast 17.

The camera 26 is not limited to the placement in an image pickup position suitable for positioning. For example, the structure in which the camera 26 is provided only for the purpose of viewing a work area in a position where the height of the forks 2 is high may be included. In this case, the image pickup position of the camera is switched between a load pickup work and a load deposition work. For such an image pickup purpose, the camera 26 can be set projecting above a load on the forks 2.

One of the image pickup positions is not limited to the storage position. In the individual embodiments in FIGS. 1 to 20(*d*), the camera position at the time of a load pickup work is not limited to the storage position but a position where the camera unit 23 is moved down a little from the storage position can be an image pickup position at the time of a load pickup work so that image pickup can be done from, for example, the same height as the forks 2 (the insertion sections). The position of the camera 26 at that time may be a position where it projects downward from the bottom surfaces of the forks 2 or a projection position where it projects downward from the carriage 18. A plurality of image pickup positions according to cargo carrying works may be provided so that the camera is stored in the storage position when a cargo carrying work is completed. That is, the storage position should not necessarily be an image pickup position but may be a position to store the camera when image pickup is unnecessary.

The movement of the camera is not limited to upward/downward and rightward/leftward sliding. For example, the camera may be made to be movable in the forward and backward directions. For example, a moving mechanism which can protract and retract the camera in the forward and backward directions in a passage which passes under the forks 2 (pallet 171) is provided so that the actuator is driven in such a way as to move the camera forward at the time of a load deposition work. Further, it is possible to employ a mechanism for sliding the camera 26 out and into, for example, the camera unit by combining a plurality of slide mechanisms or a mechanism for sliding the camera 26 out and into, for example, the support 110 by combining a slide mechanism and a rotary mechanism.

The load detecting means that detects the weight of a load placed on the forks 2 is not limited to the load weight sensor 185. This detecting means may be a limit switch to be provided on, for example, the forks or other sensors may be used as well. For example, a non-contact type sensor, such as a proximity sensor, which detects a load without contacting the load may be used. The load detecting means which detects the presence/absence of a load on the forks through an image recognition process based on an image picked up by the camera may be used. For example, the bottom shapes of the forks 2 are recognized through image recognition, the controller judges that there is no load (load pickup work) when the bottom shapes of the forks 2 can be recognized and the controller judges that there is a load (load deposition work) when the bottom surfaces of the forks 2 are obstructed by the load and the bottom shapes of the forks 2 cannot be recognized. When a limit switch or a proximity switch is used, the controller judges that it is a load deposition work when the signal output from the switch is, for example, an ON signal indicating the detection of a load and the controller judges that it is a load pickup work when the signal output from the switch is an OFF signal indicating that a load cannot be detected.

The actuator is not limited to an electric actuator. A hydraulic cylinder or pneumatic cylinder attached to the carriage may be used as an actuator. The camera is coupled to the piston rod of the cylinder and the camera 26 is moved to an image pickup position by the moving mechanism as the cylinder is protracted or retracted by hydraulic pressure or air pressure.

Although the gas damper 49 is provided as urging means for urging the camera downward, the urging means is not limited to the gas damper 49 but may be rubber, a spring or the like. Further, the urging means should not necessarily give elastic urging as given by a gas damper, rubber, a spring or the like; it may be a weight (weight) which urges the camera downward by, for example, the gravity (dead weight). For example, the mass of the portion which moves together with the camera may be increased by attaching a weight to the case of the camera unit or a forming a weight portion (a thick portion) on the case itself, so that the descending speed of the camera is secured by the gravity-originated urging.

It is not limited to an industrial vehicle in which forks are provided movable in the vehicle's widthwise direction. For example, the invention may be adapted to a forklift which does not have a side shift function.

The cargo carrying apparatus is not limited to forks. It may be an attachment other than the forks. It may be a clamping apparatus. Further, it may be a bucket. A load is not limited to a load which is handled on a pellet, but may be any of a log, a roll of paper, a container, sediment, etc. which are handled in a work by industrial vehicles. A member on which a load is deposited and a load container box other than the pallet are also included in loads. Note that "deposition" is to support and hold a load, such as forks and a packet, and "holding" is to hold a load by applying pressure to the sides of a load, as a cargo carrying apparatus, such as a clamp, displaces. Magnetic attachment to apply a holding pressure to the sides of a load is included.

The camera unit is not limited to a mechanism which is protracted or retracted under the carriage. In case where a cargo carrying apparatus other than forks is used, for example, the structure may be such that the camera unit is lifted up and down so as to be protracted and retracted above the carriage, depending on the type of the cargo carrying apparatus in use.

The actuator is not limited to the attachment to the carriage. For example, the structure may be taken in which the actuator is attached to the outer mast and the actuator is coupled to the camera unit via a flexible power transmitting member, such as a wire, a belt or a chain. In this case, the driving of the actuator is controlled in such a way as to be synchronized with drive means for lifting the cargo carrying apparatus up and down, such as the lift cylinder which lifts the forks up, and the actuator is independently controlled only when the camera unit is lifted up and down with respect to the carriage. While this structure needs a long flexible power transmitting member, such as a wire or belt, it can control the lifting of the camera unit.

The moving mechanism that moves the cargo carrying apparatus and the camera unit relatively to each other may be a mechanism which can move the cargo carrying apparatus with respect to the carriage. In this case, the camera unit is fixed to the carriage and the cargo carrying apparatus is driven for movement with respect to the carriage by the actuator. As this structure can change the relative position of the cargo carrying apparatus with the camera unit too, the image pickup position can be shifted. The camera unit and cargo carrying apparatus may be driven by a plurality of actuators.

The actuator that is used in the structure which suspends the camera unit 23 by a flexible power transmitting member is not limited to a rotary actuator, such as an electric motor. For example, a cylinder, such as a hydraulic cylinder or a pneumatic cylinder, can be used as well. That is, a flexible power transmitting member, such as a wire or a belt, can be secured to the distal end of the piston rod of the cylinder so that the camera unit 23 can be supported and suspended from the distal end of the piston rod of the cylinder via the flexible power transmitting member. The camera unit 23 is urged downward by a damper as per the above-described embodiment. As the cylinder is driven, the camera unit is lifted up and down in a suspended state. Even with this structure, the advantages provided by the use of the flexible power transmitting member and the damper (prevention of damages on the camera, etc.) are similarly obtained. As the cylinder, there is an electric power cylinder as an electric actuator besides a hydraulic cylinder and a pneumatic cylinder. When the electric power cylinder is used, the impact of the camera unit 23 is not transmitted so that damage prevention can be expected. As the flexible power transmitting member, there are a wire, a belt, a chain and so forth.

The flexible power transmitting member may be a mechanism which suspends the camera unit via a pulley or a sprocket around which a flexible power transmitting member, such as a wire or a belt, is hung. The actuator in this case may be a cylinder.

What is to be targeted is not limited to the front side of a cargo carrying apparatus. In case of a cargo carrying work in which an attachment other than forks is used, for example, when the target for positioning is located other than the front, the camera unit should be arranged in the direction to be able to pick up the image of the target. For example, for an industrial vehicle which uses a clamp to hold a load from above, the camera unit is arranged in such a way as to pick up an image below the carriage equipped with the clamp. The camera unit may be a mechanism which moves in a predetermined direction other than the up and down directions, such as forward and backward or rightward and leftward, not a mechanism which moves up and down.

The actuator may be provided on the camera unit. That is, the actuator may be provided in the case of the camera unit on the movable side that moves with respect to the carriage.

The damper is not limited to the gas damper but may be a hydraulic damper or a spring damper, for example.

The industrial vehicle is not limited to reach type forks, but may be a counter balance type forklift. It may be an industrial vehicle other than a forklift, e.g., a power shovel, which is equipped with a load handling mast. A load, a pallet, a log, sediment, cement, a person, etc. are included in loads to be subjected to a cargo carrying work. A person is referred to one in the case of a vehicle for high lift work.

The invention claimed is:

1. A camera lifting apparatus for use in an industrial vehicle equipped with a cargo handling apparatus for lifting a cargo carrying carriage up and down along a mast provided on a vehicle body, said carriage having a cargo carrying apparatus, wherein said camera lifting apparatus comprises:

a camera unit attached to said cargo carrying apparatus, said camera unit having a camera for picking up an image of a work area of said cargo carrying apparatus;

a moving mechanism for moving said camera unit relative to said cargo carrying apparatus;

an actuator for driving said moving mechanism;

a height sensor for detecting a height of said cargo carrying apparatus and sending a detection signal; and a controller for controlling said actuator to be capable of arbitrarily moving said camera unit relative to said cargo carrying apparatus, wherein said moving mechanism is a lifting mechanism for lifting said camera unit up and down with respect to said carriage and allows said camera unit to be lifted to two positions, an image pickup position in which said camera unit projects below said carriage and a storage position in which said camera unit does not project from said carriage, wherein said controller drives said actuator using the detection signal from the height sensor in such a way that said camera unit can be moved from the image pickup position to the storage position during said cargo carrying apparatus moves down from a predetermined height to a lowest lift-down position, and wherein said controller drives said actuator in such a way that said camera unit is allowed to be lifted down to said image pickup position when the height of said cargo carrying apparatus is equal to or higher than the predetermined height, the predetermined height being determined based on a time period required for moving the camera unit from the image pickup position to the storage position and a descending speed of said cargo carrying apparatus.

2. The camera lifting apparatus according to claim 1, wherein said camera can pick up an image even in said storage position, and when the height of said cargo carrying apparatus is equal to or higher than the predetermined height, said controller drives said actuator in such a way as to lift up said camera unit to place said camera unit in the storage position in order to avoid interference of said camera unit with a surrounding object.

3. The camera lifting apparatus according to claim 2, wherein in that said storage position is a position in which an image pickup section of said camera is placed at an approximately same height as a load pickup portion of said cargo carrying apparatus.

4. The camera lifting apparatus according to claim 2, wherein said image pickup position is a position in which an image of a work area can be picked up from a viewpoint which is not blocked by a load on said cargo carrying apparatus.

5. The camera lifting apparatus according to claim 1, wherein said carriage has a lift bracket, which is lifted up and down along said mast, a tilt support member provided tiltable to said lift bracket, and a side shifter provided movable along a widthwise direction of the vehicle with respect to said tilt support member, said cargo carrying apparatus is attached integrally to said side shifter, and said camera unit is provided liftable up and down with respect to said side shifter.

6. The camera lifting apparatus according to claim 1, wherein said moving mechanism is a lifting mechanism which supports said camera unit in such a way as to be liftable up and down with respect to said carriage, and said lifting mechanism has a flexible power transmitting member coupled to said camera unit to support said camera unit in a suspended fashion, and further said lifting mechanism is coupled to said actuator via said flexible power transmitting member.

7. The camera lifting apparatus according to claim 6, wherein said actuator has a rotary body which is rotated forward and reverse and winds said flexible power transmitting member by its driving, and as said flexible power transmitting member is selectively fed out from said rotary body and wound up in accordance with driving of said rotary body, said camera unit is lifted up and down in a suspended and supported fashion.

8. The camera lifting apparatus according to claim 6, further comprising urging means for urging said camera unit downward.

9. The camera lifting apparatus according to claim 8, wherein said urging means is a damper.

10. The camera lifting apparatus according to claim 6, wherein said lifting mechanism has a tensioner for giving tension to said flexible power transmitting member at a coupled portion of said flexible power transmitting member and said camera unit.

11. The camera lifting apparatus according to claim 6, wherein said actuator is an electrically operated actuator.

12. The camera lifting apparatus according to claim 1, wherein said actuator is a hydraulic cylinder attached to said carriage, and said camera unit is coupled to a piston rod of that cylinder.

13. The camera lifting apparatus according to claim 1, wherein said camera unit has a case, said lifting mechanism has at least one guide rail for guiding said camera unit in such a way as to be liftable up and down, a roller bearing which is provided on a side surface of said case and rolls on said guide rail, and a pressure receiving member for receiving a load in a thrust direction of said roller bearing.

14. The camera lifting apparatus according to claim 1, wherein in said storage position, said camera unit is stored substantially within said carriage and in said image pickup position, said camera unit is placed in such a way as to project below said cargo carrying apparatus.

15. The camera lifting apparatus according to claim 1, wherein said cargo carrying apparatus is a pair of forks and said camera unit is arranged in a center position in a widthwise direction of said pair of forks in a widthwise direction of the vehicle.

16. The camera lifting apparatus according to claim 1, wherein said industrial vehicle is a reach type industrial vehicle in which said cargo carrying apparatus reaches said vehicle body and said camera unit is provided in such a way as to be able to move with said cargo carrying apparatus.

* * * * *

UNITED STATES PATENT AND TRADEMARK OFFICE

CERTIFICATE OF CORRECTION

PATENT NO. : 7,320,385 B2
APPLICATION NO. : 10/470394
DATED : January 22, 2008
INVENTOR(S) : Kenichi Katae et al.

It is certified that error appears in the above-identified patent and that said Letters Patent is hereby corrected as shown below:

Column 1, lines 32 and 46-47, please delete “In case” and insert therefore --In the case--;

Column 2, line 5, please delete “When the forks moved” and insert therefore --When the forks are moved--;

Column 2, line 42, please delete “interferred with surrounding objects” and insert therefore --interfered with by surrounding objects--;

Column 2, line 65, please delete “In case where” and insert therefore --In the case where--;

Column 8, line 6, please delete “the finger cover 31” and insert therefore --the finger bar 31--;

Column 10, line 5, please delete “That is, in case where” and insert therefore --That is, in the case where--;

Column 11, line 29, please delete “surrounding obstacles is concerned.” and insert therefore --surrounding obstacles is of concern.--;

Column 11, line 55, please delete “In case where” and insert therefore --In the case where--;

Column 12, line 28, please delete “before the forks 2 descends” and insert therefore --before the forks 2 descend--;

Column 12, lines 60-61, please delete “In case of the sensor that continuously detect the height,” and insert therefore --In the case of the sensor that continuously detects the height,--;

Column 13, lines 3-4, please delete “forks 2 to be discussed later is executed.” and insert therefore --forks 2, to be discussed later.--;

UNITED STATES PATENT AND TRADEMARK OFFICE

CERTIFICATE OF CORRECTION

PATENT NO. : 7,320,385 B2
APPLICATION NO. : 10/470394
DATED : January 22, 2008
INVENTOR(S) : Kenichi Katae et al.

It is certified that error appears in the above-identified patent and that said Letters Patent is hereby corrected as shown below:

Column 14, lines 28, 35 and 37, please delete "in case" and insert therefore --in the case--;

Column 14, lines 51 and 61, please delete "In case where" and insert therefore --In the case where--;

Column 16, line 29, please delete "as a wide image pickup area" and insert therefore --as wide an image pickup area--;

Column 16, lines 63-64, please delete "In case where" and insert therefore --In the case where--;

Column 17, line 10, please delete "image processing can be secured wide." and insert therefore --image processing is wide.--;

Column 17, line 11, please delete "(3) In case" and insert therefore --(3) In the case--;

Column 17, line 66, please delete "mainly on those portions which differ" and insert therefore --mainly about those portions which differ--;

Column 18, line 21, please delete "mainly on those portions which differ" and insert therefore --mainly about those portions which differ--;

Column 18, line 48, please delete "Be noted that" and insert therefore --It is noted that--;

Column 18, line 52, please delete "given only on those portions" and insert therefore --given only about those portions--;

Column 22, line 6, please delete "the forks 2 reaches" and insert therefore --the forks 2 reach--;

Column 23, lines 11-12, 14-15, 21, 50-51 and 51, please delete "display processing section 95" and insert therefore --display processing section 195--;

UNITED STATES PATENT AND TRADEMARK OFFICE

CERTIFICATE OF CORRECTION

PATENT NO. : 7,320,385 B2
APPLICATION NO. : 10/470394
DATED : January 22, 2008
INVENTOR(S) : Kenichi Katae et al.

It is certified that error appears in the above-identified patent and that said Letters Patent is hereby corrected as shown below:

Column 24, line 67, please delete "camera 26, d is the center distance" and insert therefore --camera 26, and d is the center distance--;

Column 25, lines 52-53, please delete "Each control section 176, 77" and insert therefore --Each control section 176, 177--;

Column 27, line 38, please delete "predetermined distance AL" and insert therefore --predetermined distance $^{\Delta}$L--;

Column 27, line 60, please delete "the forks 2 reaches" and insert therefore --the forks 2 reach--;

Column 29, line 8, please delete "the forks 2 reaches" and insert therefore --the forks 2 reach--;

Column 29, line 52, please delete "Be noted that" and insert therefore --It is noted that--;

Column 30, lines 66-67, please delete "camera 26 at that time, data of the rotational angle" and insert therefore --camera 26, data of the rotational angle--;

Column 32, lines 37-38, please delete "directions is, the greater the lift-down amount of the camera is made." and insert therefore --directions, the greater the lift-down amount of the camera.--;

Column 33, lines 11 and 15, please delete "In case where" and insert therefore --In the case where--;

Column 34, lines 64-65, please delete "for example, the gravity (dead weight)." and insert therefore --for example, gravity (dead weight).--;

Column 34, line 67, please delete "or a forming a wieight" and insert therefore --or forming a weight--; and

UNITED STATES PATENT AND TRADEMARK OFFICE

CERTIFICATE OF CORRECTION

PATENT NO. : 7,320,385 B2
APPLICATION NO. : 10/470394
DATED : January 22, 2008
INVENTOR(S) : Kenichi Katae et al.

It is certified that error appears in the above-identified patent and that said Letters Patent is hereby corrected as shown below:

Column 35, line 22, please delete "In case where" and insert therefore --In the case where--.

Signed and Sealed this

Twenty-fifth Day of August, 2009

David J. Kappos

David J. Kappos
*Director of the United States Patent and Trademark Office*